US006667728B2

(12) United States Patent
Kanazawa et al.

(10) Patent No.: US 6,667,728 B2
(45) Date of Patent: Dec. 23, 2003

(54) PLASMA DISPLAY PANEL AND METHOD OF DRIVING THE SAME CAPABLE OF INCREASING GRADATION DISPLAY PERFORMANCE

(75) Inventors: Yoshikazu Kanazawa, Kawasaki (JP); Kosaku Toda, Kawasaki (JP); Shigeharu Asao, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 244 days.

(21) Appl. No.: 09/783,970

(22) Filed: Feb. 16, 2001

(65) Prior Publication Data

US 2001/0054992 A1 Dec. 27, 2001

(30) Foreign Application Priority Data

Jun. 21, 2000 (JP) ..... 2000-186802

(51) Int. Cl.[7] ..... G09G 3/28
(52) U.S. Cl. ..... 345/60; 345/67; 315/169.4
(58) Field of Search ..... 345/60–63, 66, 345/68, 74.1, 76; 315/167, 168, 169.1, 169.4; 313/484, 491, 514, 517, 520

(56) References Cited

U.S. PATENT DOCUMENTS

| | | | | |
|---|---|---|---|---|
| 6,100,859 A | | 8/2000 | Kuriyama et al. | |
| 6,104,362 A | | 8/2000 | Kuriyama et al. | |
| 6,144,349 A | * | 11/2000 | Awata et al. | 345/62 |
| 6,160,529 A | * | 12/2000 | Asao et al. | 345/60 |

FOREIGN PATENT DOCUMENTS

| | | |
|---|---|---|
| EP | 0 762 373 | 3/1997 |
| FR | 2 738 377 | 3/1997 |

OTHER PUBLICATIONS

Kanazawa, Y. et al., "High–Resolution Interlaced Addressing for Plasma Displays", SID 99 Digest, pp. 154–157, May 18, 1999.

* cited by examiner

*Primary Examiner*—Bipin Shalwala
*Assistant Examiner*—Mansour M. Said
(74) *Attorney, Agent, or Firm*—Staas & Halsey LLP

(57) ABSTRACT

A plasma display panel has a plurality of first electrodes, a plurality of second electrodes adjacently disposed alternately with the first electrodes, first display lines formed between the first electrodes and the second electrodes adjacent to one side of the first electrodes, second display lines formed between the first electrodes and the second electrodes adjacent to the other side of the first electrodes, and a control circuit for alternately lighting the first and second display lines or lighting only one of the first and second display lines, and for displaying an image on the plasma display panel by dividing a frame or a field into a plurality of sub-fields for a gradation display. When cells are lighted on the adjacent first display lines or on the adjacent second display lines in a direction crossing the first and second electrodes, a compensation sustain discharge is carried out a plurality of times on the second display lines or on the first display lines positioned between the adjacent first display lines or between the adjacent second display lines, after a sustain discharge period on the first or second display lines ends.

23 Claims, 23 Drawing Sheets

DISCHARGE ON ODD LINES

DISCHARGE ON EVEN LINES

[ODD FIELD]

[EVEN FIELD]

PLASMA DISPLAY PANEL AND METHOD OF DRIVING THE SAME CAPABLE OF INCREASING GRADATION DISPLAY PERFORMANCE

BACKGROUND OF THE INVENTION

1. Field of the Invention

The present invention relates to a technique of driving a plasma display panel and, more particularly, to a plasma display panel of an ALIS system and a method of driving this plasma display panel.

2. Description of the Related Art

Recently, as a plasma display panel (PDP) that is capable of obtaining a high definition and a high aperture ratio, there has been proposed a PDP of an ALIS (Alternate Lighting of Surfaces) system. In such a PDP of the ALIS system, there has been a high demand for increasing the gradation display performance by avoiding a distortion in the brightness that is generated depending on a lighting pattern and by preventing the occurrence of an abnormal discharge.

Specifically, the conventional PDP of the ALIS system has a problem in that the linearity of the gradation fails depending on the display pattern. This problem is not limited to a PDP of the ALIS system. A similar problem also exists in a PDP in which there is a short interval between the discharged display lines, and the pitches of the cells are short so that the discharge in the adjacent cells is partially superimposed.

The prior art and the problems associated with the prior art will be described later, in detail, with reference to accompanying drawings.

SUMMARY OF THE INVENTION

An object of the present invention is to provide a plasma display panel and a method of driving the same capable of increasing the gradation display performance by avoiding distortion in the brightness that is generated depending on a lighting pattern. It is another object of the present invention to provide a plasma display panel and a method of driving the same capable of preventing an occurrence of an abnormal discharge in the PDP.

According to the present invention, there is provided a method of driving a plasma display panel having a plurality of first electrodes and a plurality of second electrodes adjacently disposed alternately, first display lines being formed between the first electrodes and the second electrodes adjacent to one side of the first electrodes, second display lines being formed between the first electrodes and the second electrodes adjacent to the other side of the first electrodes, the first and second display lines alternately lighting or only one of the first and second display lines lighting, and an image being displayed on the plasma display panel by dividing a frame or a field into a plurality of sub-fields for a gradation display, comprising the steps of carrying out a sustain discharge in a sustain discharge period cells when are lighted on the adjacent first display lines or on the adjacent second display lines in a direction crossing the first and second electrodes; and carrying out a compensation sustain discharge a plurality of times on the second display lines or on the first display lines positioned between the adjacent first display lines or between the adjacent second display lines.

The first electrodes and the second electrodes may be disposed alternately in parallel with each other, and cells that are lighted on the adjacent first display lines or on the adjacent second display lines may be cells on the first display lines or the second display lines that are adjacent to each other in a direction orthogonal with the first and second electrodes. The compensation sustain discharge may be carried out in at least sub-fields in which a sustain discharge is carried out most. The number times of carrying out the compensation sustain discharge is carried out in each sub-field may be allocated in a ratio approximately proportional to the number of sustain discharge. A width of a pulse discharged at the beginning may be set large among the widths of the compensation sustain discharge pulses.

The method may comprise the steps of applying a sustain discharge pulse to cancel the voltage of the second display lines when a sustain discharge is carried out on the first display lines, or, of applying a sustain discharge pulse to cancel the voltage of the first display lines when a sustain discharge is carried out on the second display lines; inverting wall charges of cells where the sustain discharge is carried out by applying an inverted pulse necessary for a discharge only between pairs of electrodes of either odd display lines or even display lines among the first display lines; and carrying out a compensation sustain discharge a predetermined number of times, by applying compensation sustain discharge pulses such that a voltage is generated between electrodes that form display lines where the sustain discharge was not carried out during the sustain discharge period immediately before, and that a voltage is not generated between electrodes that form display lines where the sustain discharge was carried out during the sustain discharge period immediately before.

The width of the inverted pulse may be set larger than the width of the sustain discharge pulse. The voltage of the inverted pulse may be set higher than the voltage of the sustain discharge pulse. A voltage of a pulse discharged at the beginning may be set high among voltages of the compensation sustain discharge pulses. The method of driving the plasma display panel may further comprise the step of applying a voltage pulse necessary for a discharge to only pairs of electrodes of odd or even display lines among the first or second display lines where the compensation sustain discharge is carried out, thereby wall charges of cells where the compensation sustain discharge is carried out is inverted and polarities of wall charges formed on the first electrodes and on the second electrodes are matched on the respective electrodes.

Further, according to the present invention, there is also provided a plasma display panel comprising a plurality of first electrodes; a plurality of second electrodes adjacently disposed alternately with the first electrodes; first display lines formed between the first electrodes and the second electrodes adjacent to one side of the first electrodes; second display lines formed between the first electrodes and the second electrodes adjacent to the other side of the first electrodes; and a control circuit for alternately lighting the first and second display lines or lighting only one of the first and second display lines, and for displaying an image on the plasma display panel by dividing a frame or a field into a plurality of sub-fields for a gradation display, wherein when cells are lighted on the adjacent first display lines or on the adjacent second display lines in a direction crossing the first and second electrodes, a compensation sustain discharge is carried out by a plurality of times on the second display lines or on the first display lines positioned between the adjacent first display lines or between the adjacent second display lines, after a sustain discharge period on the first or second display lines is finished.

The plasma display panel may further comprise a memory for storing the number of times carrying out a sustain discharge on cells that are lighted on the adjacent first display lines or on the adjacent second display lines, and controls the number times of carrying out a compensation sustain discharge on the second display lines positioned between the adjacent first display lines or on the first display lines positioned between the adjacent second display lines, according to the number of times carrying out the sustain discharge stored in the memory.

BRIEF DESCRIPTION OF THE DRAWINGS

The present invention will be more clearly understood from the description of the preferred embodiments as set forth below with reference to the accompanying drawings, wherein.

DETAILED DESCRIPTION OF THE PREFERRED EMBODIMENTS

Before making a detailed description of the present invention, there will be first explained a conventional plasma display panel, a conventional method of driving the plasma display panel, and problems in the conventional techniques, with reference to the drawings.

Figure 1A:
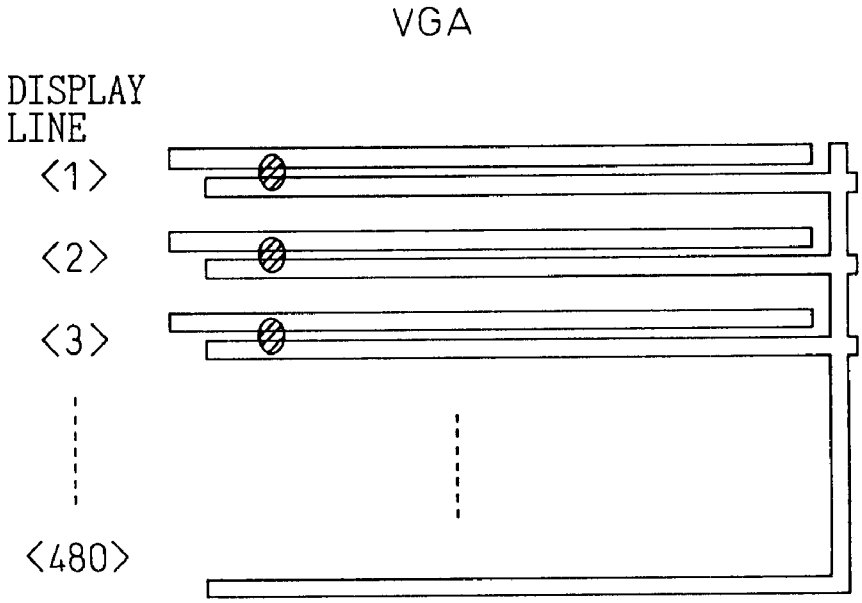
FIG. 1A and FIG. 1B are diagrams showing a comparison between a plasma display panel (PDP) of the ALIS system to which the present invention is applied and a conventional plasma display panel.
Figure 1B:
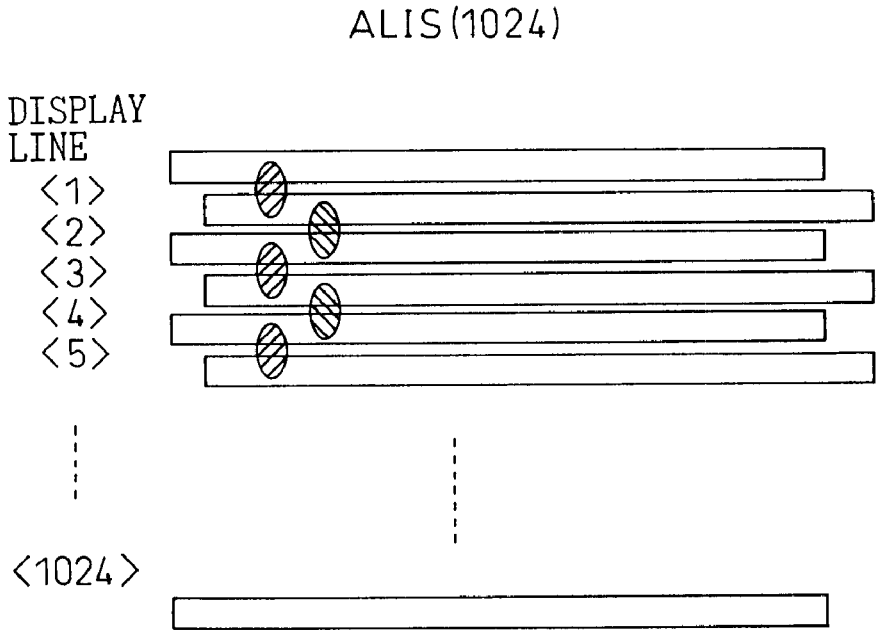

FIG. 1A and FIG. 1B are diagrams showing a comparison between a plasma display panel (PDP) of the ALIS system to which the present invention is applied and a conventional plasma display panel. FIG. 1A shows a conventional PDP (for example, a VGA type having 480 display lines), and FIG. 1B shows a PDP of the ALIS system (for example, having 1,024 display lines).

As shown in FIG. 1A, the conventional PDP has two display electrodes disposed in parallel. In order to carry out a display discharge between these electrodes, it is necessary to provide twice as many display electrodes (also called a sustain electrode) as the number of display lines. For example, in the case of a VGA having 480 display lines, 480×2=960 display electrodes are necessary.

On the other hand, in the case of the PDP of the ALIS system, a display is carried out by generating a discharge between all the adjacent electrodes as disclosed in, for example, Japanese Patent Publication No. 2801893 (Japanese Patent Application Laid-open Publication No. Hei 9-160525: corresponding to EP 0762373-A2), and as shown in FIG. 1B. According to this system, the required number of display electrodes is the number of display lines plus one. For example, when there are 1,024 display lines, the required number of electrodes is 1,024+1=1,025.

In other words, according to the PDP of the ALIS system, it is possible to achieve a high definition of two times that achieved by the conventional system, by using a number of electrodes similar to that of the conventional system. Further, according to the PDP of the ALIS system, it is possible to minimize the shielding of light beams due to electrodes, based on an efficient use of discharging space, without waste. As a result, a high aperture ratio can be obtained, and a high brightness can be realized.

Figure 2:
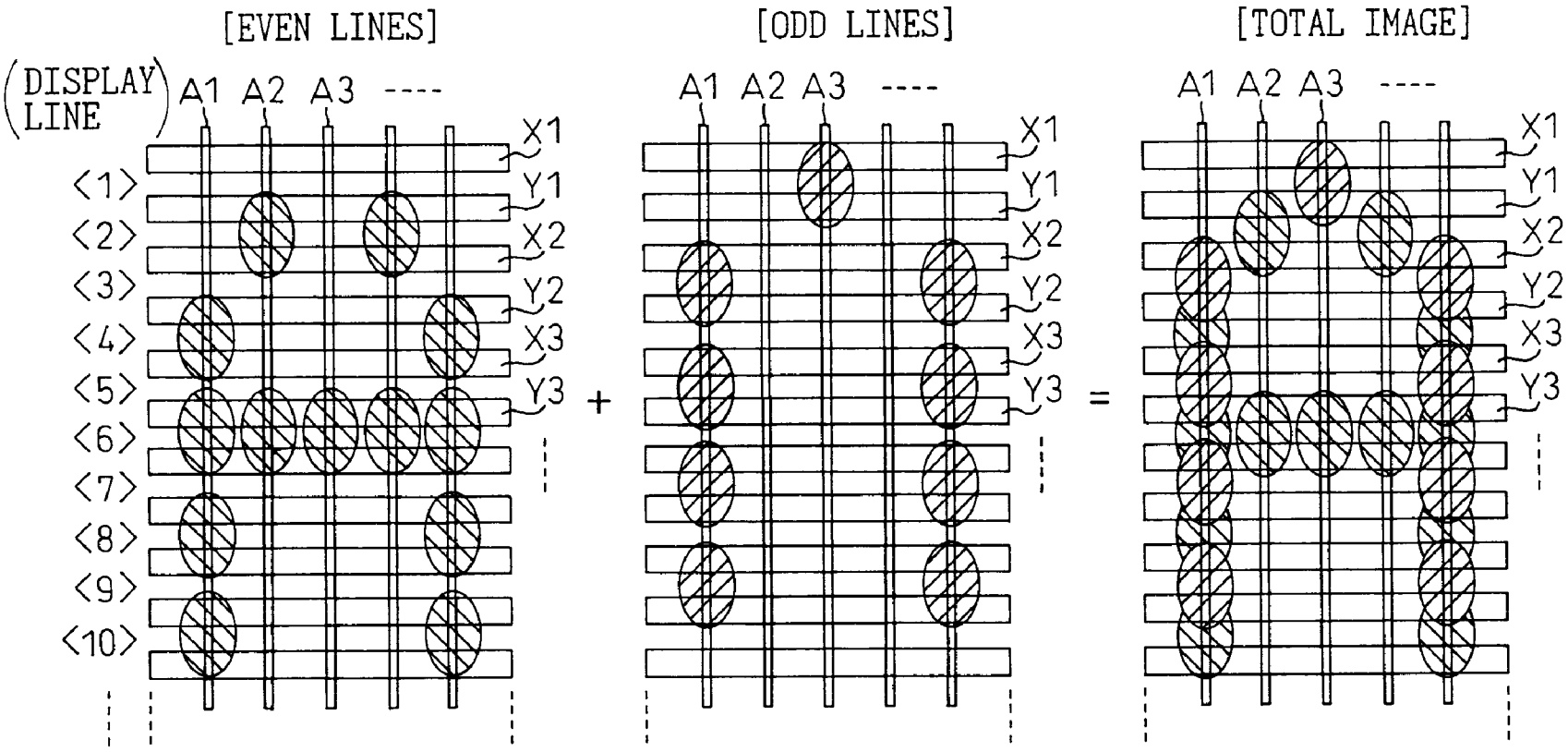
FIG. 2 is a diagram for explaining a method of displaying on a PDP of the ALIS system.

FIG. 2 is a diagram for explaining a method of displaying on a PDP of the ALIS system. This shows an example of displaying a character "A". In FIG. 2, X-electrodes X1, X2, - - - , and Y-electrodes Y1, Y2, - - - are display electrodes (sustain electrodes). A1, A2, - - - are address electrodes.

As shown in FIG. 2, according to the display method of the ALIS system, the display of an image is divided into odd lines and even lines in time order. For example, a display is made on odd lines (display lines <1>, <3>, <5>, - - - ) based on the discharge between the X-electrodes electrodes(X1, X2, - - - ) and the Y-electrodes (Y1, Y2, - - - ) below these X-electrodes. Also, a display is made on even lines (display lines <2>, <4>, <6>, - - - ) based on the discharge between the Y-electrodes (Y1, Y2, - - - ) and the X-electrodes (X2, X3, - - - ) below these Y-electrodes. These two sets of displays are combined together to make a display of a whole image. This display method is very similar to that of interlaced scanning of a picture tube.

Figure 3A:
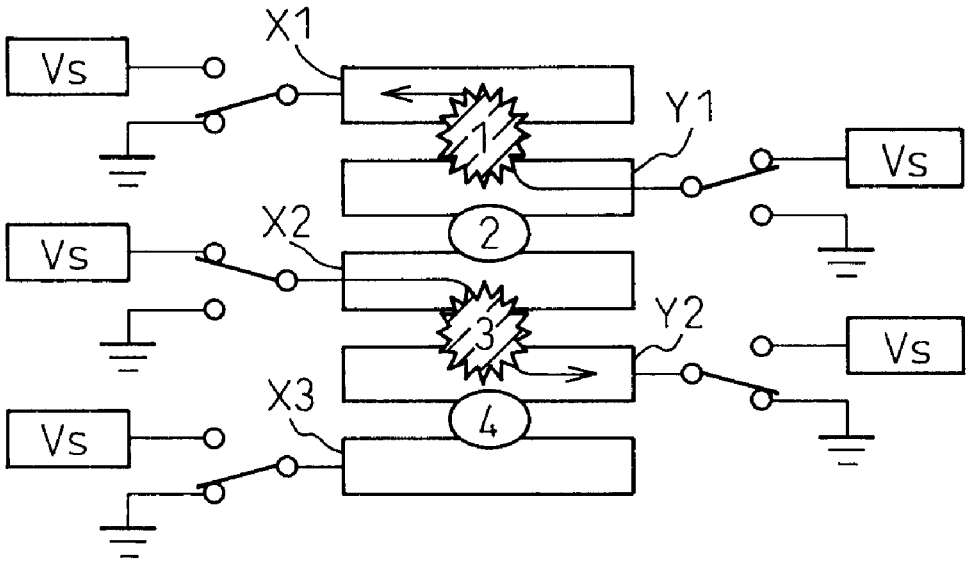
FIG. 3A and FIG. 3B are diagrams for explaining the operation principle of a PDP of the ALIS system.
Figure 3B:
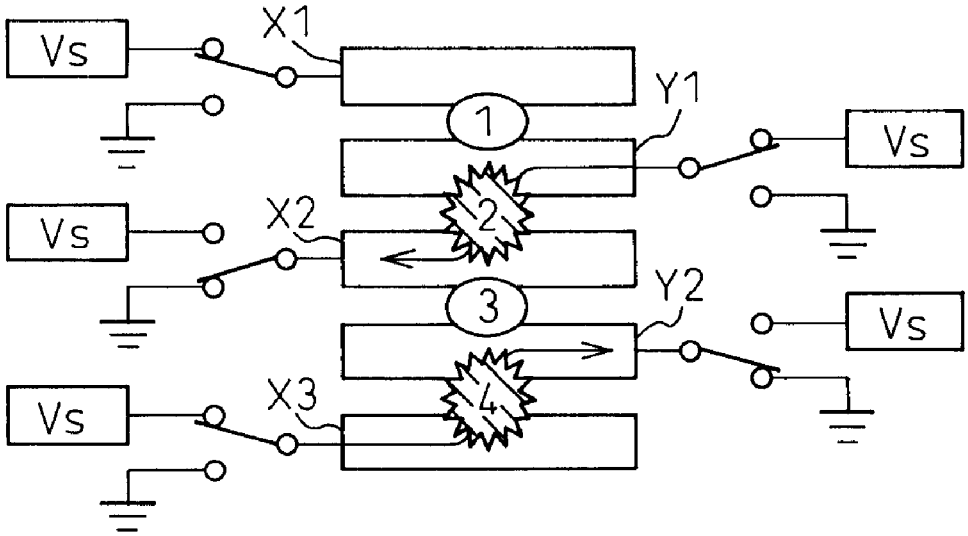

FIG. 3A and FIG. 3B are diagrams for explaining the operation principle of a PDP of the ALIS system. FIG. 3A shows the operation during a discharge (display) of the odd lines, and FIG. 3B shows the operation during a discharge (display) of the even lines.

As shown in FIG. 3A, in order to make a stable discharge on the odd display lines (display lines <1>, <3>, - - - ), for example, the odd X-electrodes X1, X3, - - - are grounded (for example, zero volt), a voltage Vs is applied to the odd Y-electrodes Y1, Y3, - - - , a voltage Vs is applied to the even X-electrodes X2, X4, - - - , and the even Y-electrodes Y2, Y4, - - - are grounded. Based on this arrangement, a current is discharged to the odd display lines <1>, <3>, - - - , and a current is not discharged to the even lines <2>, <4>, - - - . In other words, a current is discharged to the first display line <1> based on a voltage (Vs) generated between the grounded first X-electrode X1 and the first Y-electrode Y1 to which the voltage Vs has been applied. Further, a current is discharged to the third display line <3> based on a voltage (Vs) generated between the second X-electrode X2 to which the voltage Vs has been applied and the grounded second Y-electrode Y2. In this case, a current is not discharged to the second display line <2> as there occurs no potential difference between the first Y-electrode Y1 to which the voltage Vs has been applied and the second X-electrode X2 to which the voltage Vs has been applied. Further, a current is not discharged to the fourth display line <4> as there occurs no potential difference between the grounded second Y-electrode Y2 and the grounded third X-electrode X3.

On the other hand, as shown in FIG. 3B, in order to make a stable discharge on the even display lines (display lines <2>, <4>, - - - ), for example, a voltage Vs is applied to the odd X-electrodes X1, X3, - - - and to the odd Y-electrodes Y1, Y3, - - - , and the even X-electrodes X2, X4, - - - , and the even Y-electrodes Y2, Y4, - - - are grounded. Based on this arrangement, a current is discharged to the even display lines <2>, <4>, - - - , and a current is not discharged to the odd lines <1>, <3>, - - - . In other words, a current is discharged to the second display line <2> based on a voltage (Vs) generated between the first Y-electrode Y1 to which the voltage Vs has been applied and the grounded second X-electrode X2. Further, a current is discharged to the fourth display line <4> based on a voltage (Vs) generated between the grounded second Y-electrode Y2 and the third X-electrode X3 to which the voltage Vs has been applied. In this case, a current is not discharged to the first display line <1> as there occurs no potential difference between the first X-electrode X1 to which the voltage Vs has been applied and the first Y-electrode Y1 to which the voltage Vs has been applied. Further, a current is not discharged to the third display line <3> as there occurs no potential difference between the grounded second X-electrode X2 and the grounded second Y-electrode Y2.

By alternately repeating the discharge on the odd lines shown in FIG. 3A and the discharge on the even lines shown in FIG. 3B, the discharge of the odd lines and the discharge of the even lines are combined together. As a result, a total image is displayed.

Figure 4:
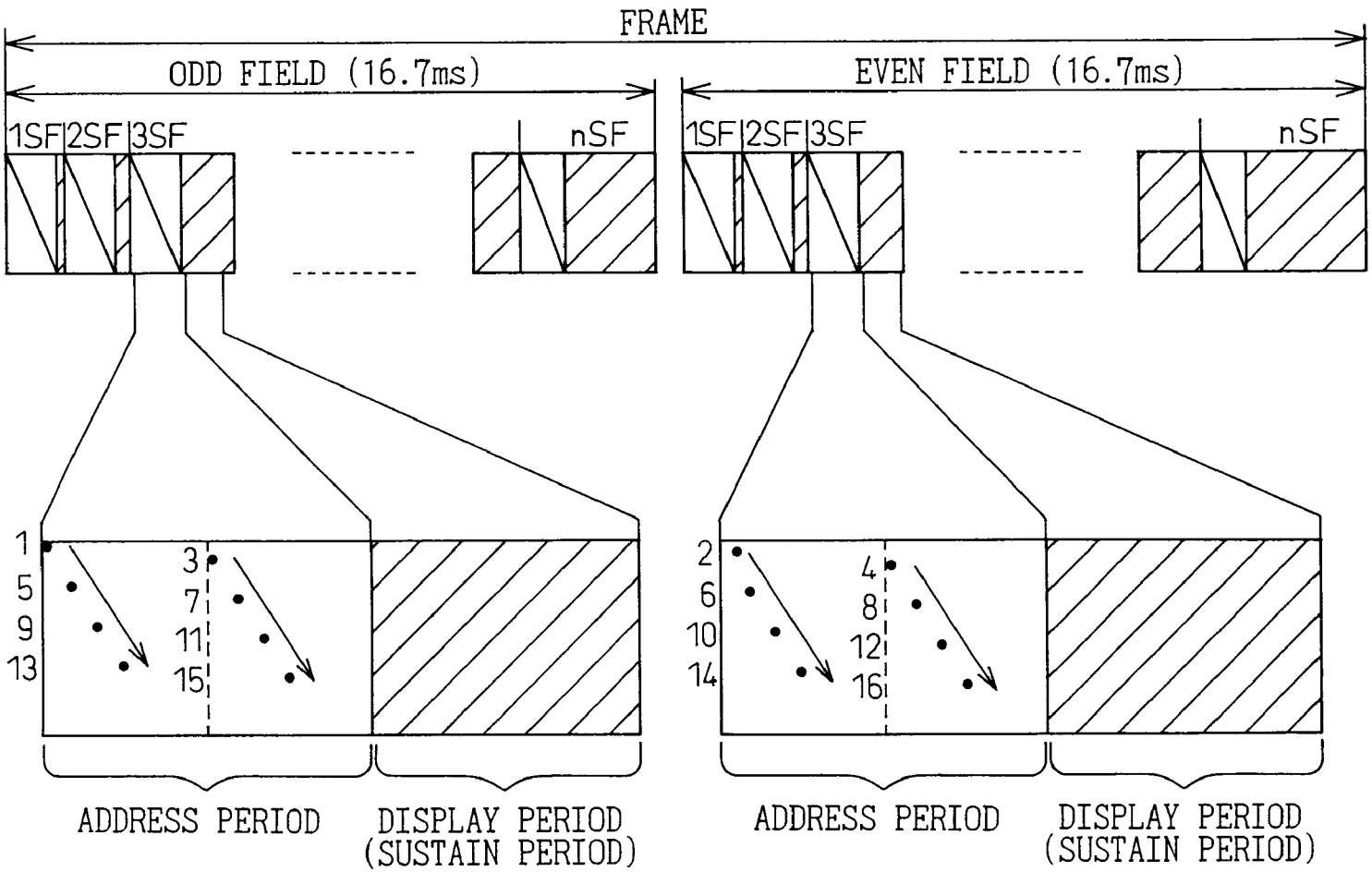
FIG. 4 is a diagram showing one example of a display sequence of a PDP of the ALIS system.

FIG. 4 is a diagram showing one example of a display sequence of a PDP of the ALIS system.

As explained above, according to the PDP of the ALIS system, a display of a total screen is carried out by dividing the display into a display (discharge) of the odd lines and a display of the even lines. Therefore, one frame is divided into an odd field and an even field as shown in FIG. 4. Each of these odd and even fields is further divided into a plurality of sub-fields (1SF to nSF). It is necessary to divide each field into the plurality of sub-fields in order to carry out a gradation display. Usually, in order to realize a graduation of about 50 to 300, each field is divided into about eight to twelve sub-fields (SF).

Each sub-field (4SF to nSF) is further divided into a reset period (not shown in FIG. 4: positioned before an address period) for initializing a state of the discharge cell, an address period for writing into a lighting cell according to a display data, and a display period (a sustain period) for making a display using a cell selected during the address period. During the display period, a discharge is carried out repeatedly (a sustain discharge). The weight of the brightness of each sub-field is determined based on the number of this repetition.

Figure 5:
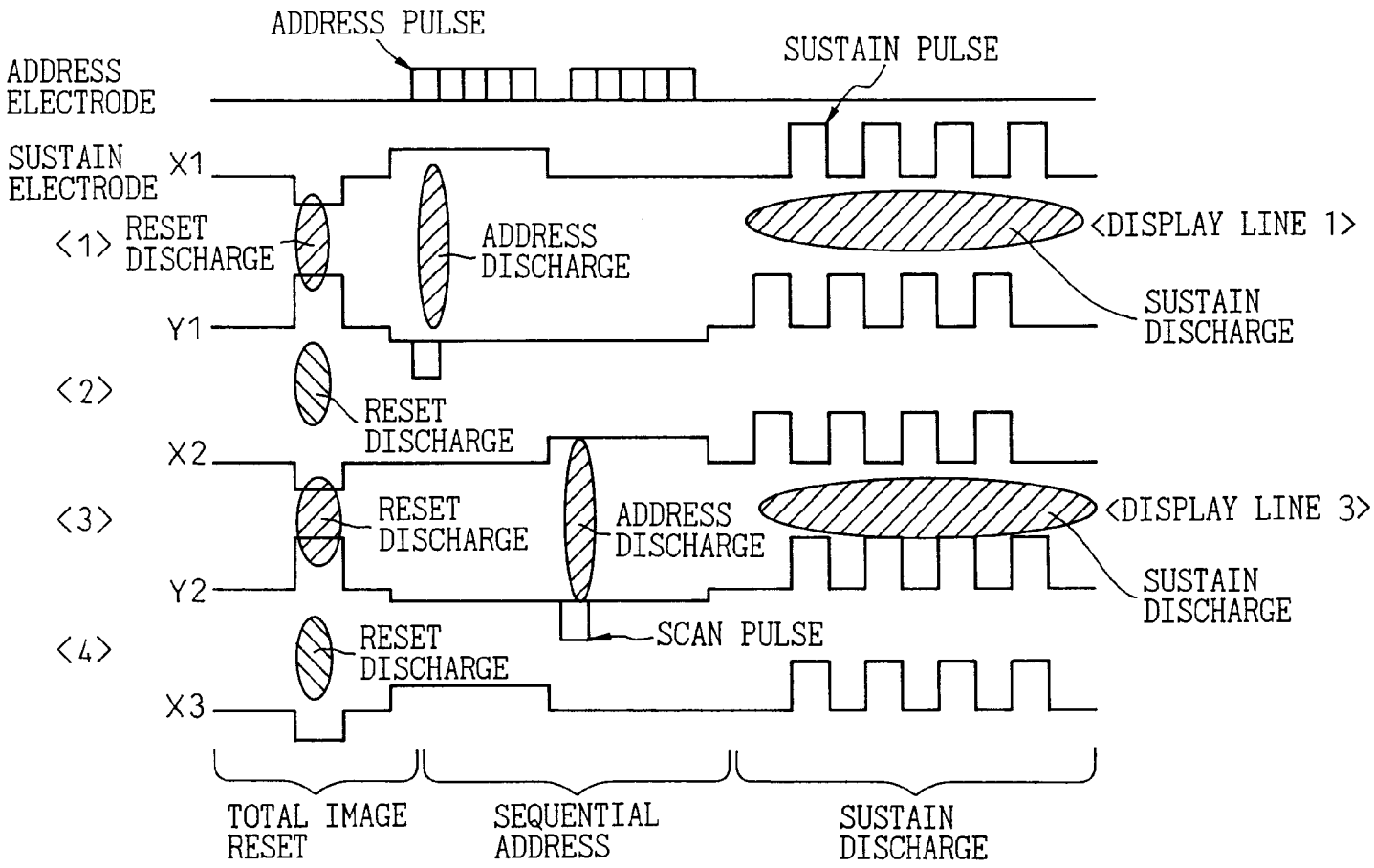
FIG. 5 is a diagram (an odd field) showing one example of a driving waveform according to the ALIS system.
Figure 6:
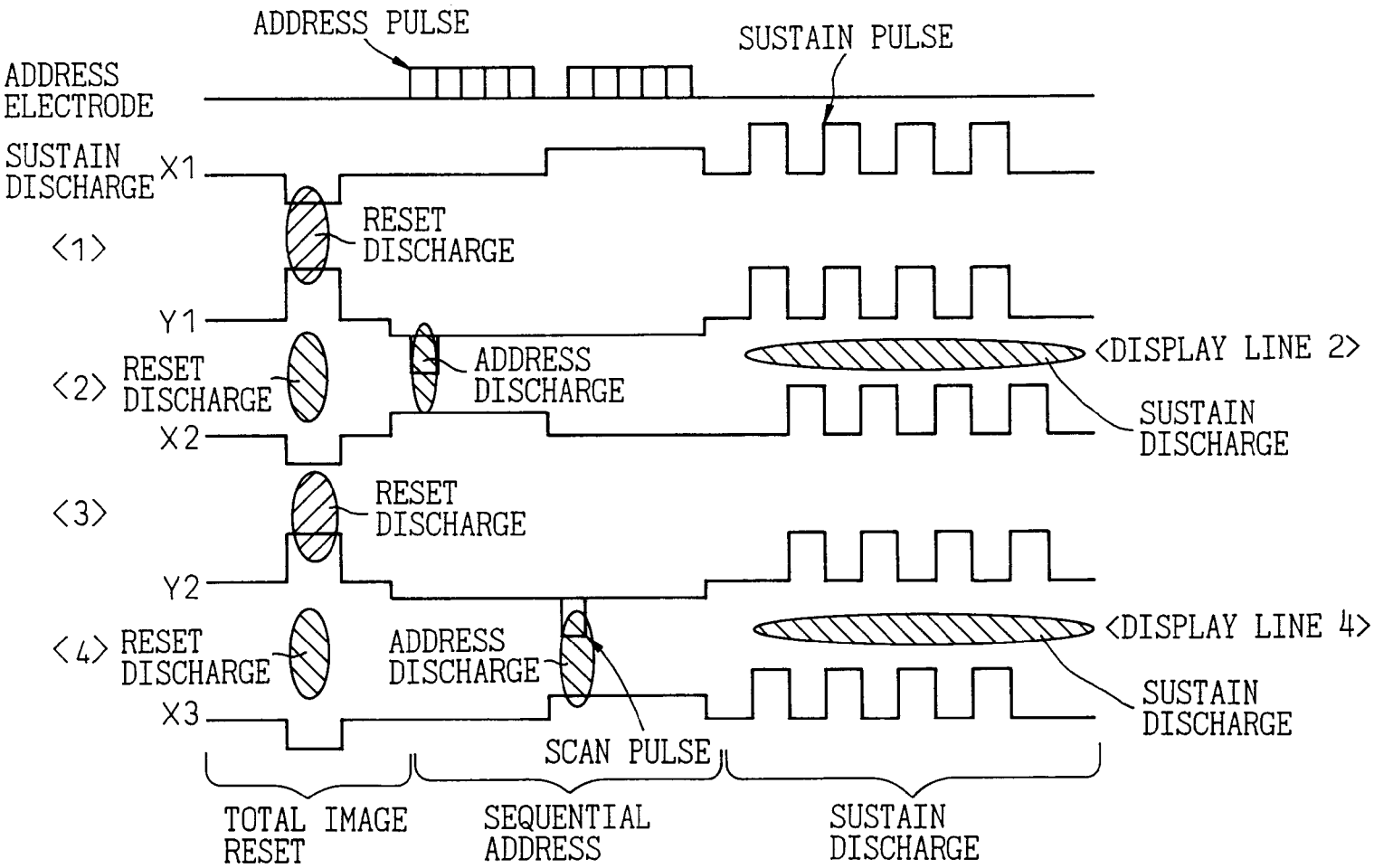
FIG. 6 is a diagram (an even field) showing one example of a driving waveform according to the ALIS system.

FIG. 5 is a diagram (part 1: an odd field) showing one example of a driving waveform according to the ALIS system, and FIG. 6 is a diagram (part 2: an even field) showing one example of a driving waveform according to the ALIS system. Each drawing shows a driving waveform of one sub-field.

As shown in FIG. 5, in the driving waveform of one sub-field in the odd field, a voltage pulse is applied to between all the adjacent X-electrodes X1, X2, - - - and Y-electrodes Y1, Y2, - - - , thereby to carry out an initial discharge (a reset discharge), during the reset period. During the address period, a selective pulse (a scan pulse) is sequentially applied to the Y-electrodes Y1, Y2, - - - , and an address pulse is applied to the address electrode (A1, A2, - - - ) corresponding to a selective cell, thereby executing a write discharge (an address discharge). After executing the reset discharge and the write discharge to the whole screen, a sustain pulse is applied alternately to the X-electrodes and the Y-electrodes, thereby executing a sustain discharge (a sustain discharge). FIG. 5 shows a driving waveform of the odd field for carrying out a display of the odd lines (odd display lines <1>, <3>, - - - ). In FIG. 5, the address discharge and the sustain discharge are generated to only the odd display lines.

FIG. 6 shows a driving waveform of the even field for displaying the even lines (the even display lines <2>, <4>, - - - ). This corresponds to the driving waveform in the odd field shown in FIG. 5. In FIG. 6, the address discharge and the sustain discharge are generated at only the even display lines.

Figure 7:
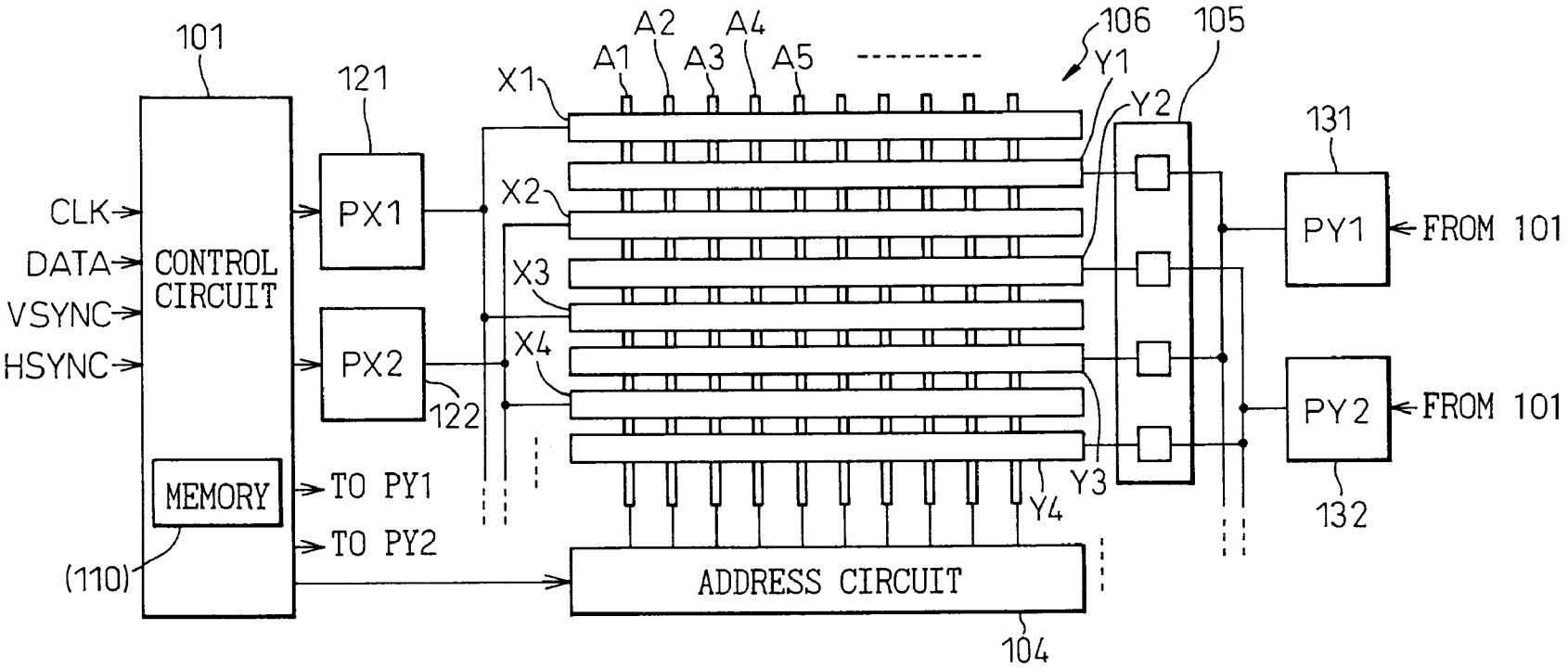
FIG. 7 is a circuit block diagram showing one example of a PDP of the ALIS system to which the present invention is applied.

FIG. 7 is a circuit block diagram showing one example of a PDP (a PDP apparatus) of the ALIS system to which the present invention is applied. In FIG. 7, a reference symbol 101 denotes a control circuit, 121 denotes a sustaining circuit for odd X-electrodes (PX1), 122 denotes a sustaining circuit for even X-electrodes (PX2), 131 denotes a sustaining circuit for odd Y-electrodes (PY1), 132 denotes a sustaining circuit for even Y-electrodes (PY2), 104 denotes an address circuit (an address driver), 105 denotes a scanning circuit (a scan driver), and 106 denotes a display panel (PDP).

The control circuit 101 converts display data DATA supplied from the outside into data for the display panel 106, and supplies the converted data to the address circuit 104. The control circuit 101 further generates various control signals according to a clock CLK, a vertical synchronization signal VSYNC, and a horizontal synchronization signal HSYNC, and controls the circuits 121, 122, 131, 132, 104, and 105. In order to apply the voltage waveforms shown in FIG. 5 and FIG. 6 to the electrodes, a power source (not shown) supplies predetermined voltages to the sustaining circuit for odd X-electrodes 121, the sustaining circuit for even X-electrodes 122, the sustaining circuit for odd Y-electrodes 131, the sustaining circuit for even Y-electrodes 132, the address circuit 104, and the scanning circuit 105, respectively.

Figure 8:
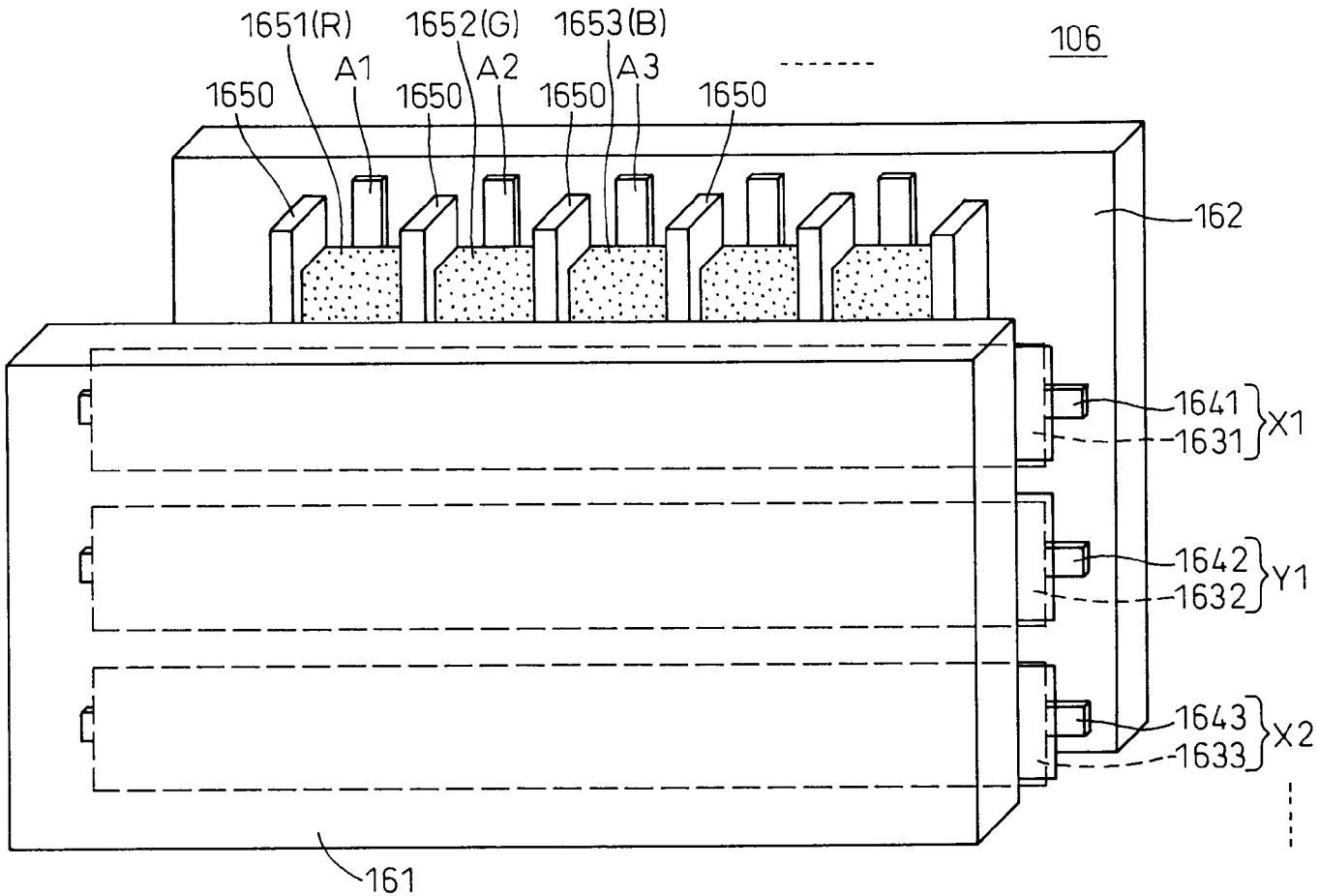
FIG. 8 is a diagram showing one example of a panel structure of a PDP of the ALIS system.

FIG. 8 is a diagram showing one example of a panel structure of a PDP of the ALIS system. The display panel 106 includes a color type and a monochromatic type. FIG. 8 shows a case of the color display panel.

As shown in FIG. 8, on a front glass substrate 161, there are alternately formed in parallel the X-electrodes and Y-electrodes X1, Y1, X2, - - - that are structured by transparent electrodes like IT0 films 1631, 1632, 1633, - - - and metal electrodes like copper electrodes 1641, 1642, 1643, - - - . In this case, in the X-electrode X1, for example, the metal electrode 1641 is provided along a longitudinal direction of its transparent electrode 1631 in order to decrease a reduction in the voltage due to the transparent electrode 1631. A dielectric for holding a wall charge and a protection film like an MgO film (not shown) are provided over the whole surface of the transparent electrodes 1631, 1632, 1633, - - - and the metal electrodes 1641, 1642, 1643, - - - that constitute the X-electrodes and Y-electrodes X1, Y1, X2, - - - , and over the whole inner surface of the front glass substrate 161.

On a rear glass substrate 162, there are formed the address electrodes A1, A2, A3, - - - and partitions 1650 surrounding these address electrodes, in a direction orthogonal with the X-electrodes and the Y-electrodes X1, Y1, X2, - - - , on the surface opposite to the MgO protection film of the front glass substrate 161. Phosphors 1651, 1652, 1653, - - - that emit various colors (a red color R, a green color G, and a blue color B) based on an incidence of ultraviolet rays generated by a discharge are coated on the address electrodes A1, A2, A3, - - - that are surrounded by the partitions 1650. A Penning mixed gas of Ne+Xe is sealed into a discharge space formed between the MgO protection film (the inner surface) of the front glass substrate 161 and the phosphors (the inner surface) of the rear glass substrate 162.

The odd X-electrodes X1 (X3, X5, - - - ) of the front glass substrate 161 are connected to the sustaining circuit for odd X-electrodes 121 shown in FIG. 7, and the even X-electrodes X2 (X4, X6, - - - ) are connected to the sustaining circuit for even X-electrodes 122. The odd Y-electrodes Y1 (Y3, Y5, - - - ) are connected to the sustaining circuit for odd Y-electrodes 131 via the scanning circuit 105 (the IC for scan driving) 105, and the even Y-electrodes Y2 (Y4, Y6, - - - ) are connected to the sustaining circuit for even Y-electrodes 132 via the scanning circuit 105. Based on this arrangement, the above-described driving of the ALIS system is carried out.

Figure 9:
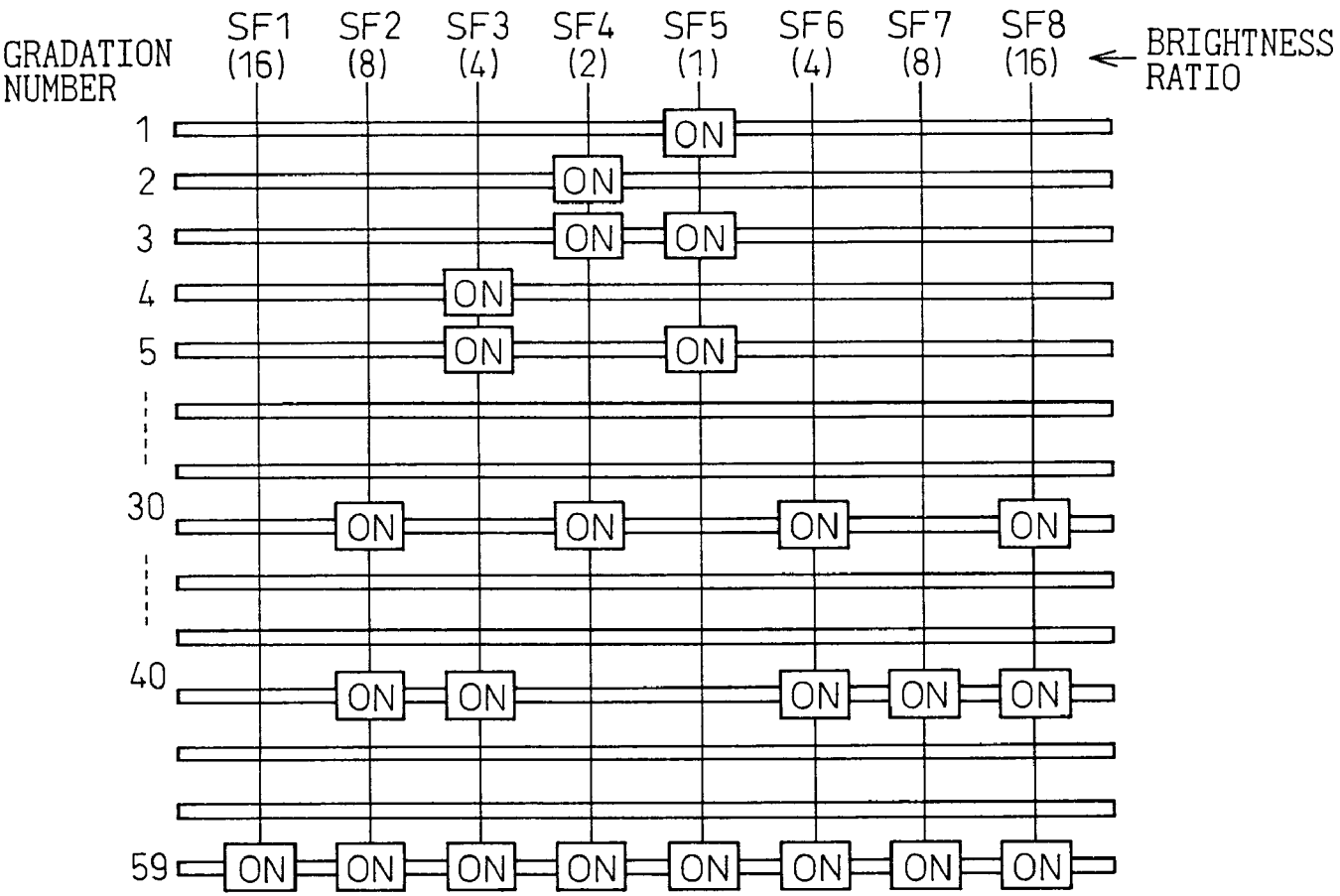
FIG. 9 is a diagram showing a relationship between the gradation of first group cells and a lighting sub-field.
Figure 10:
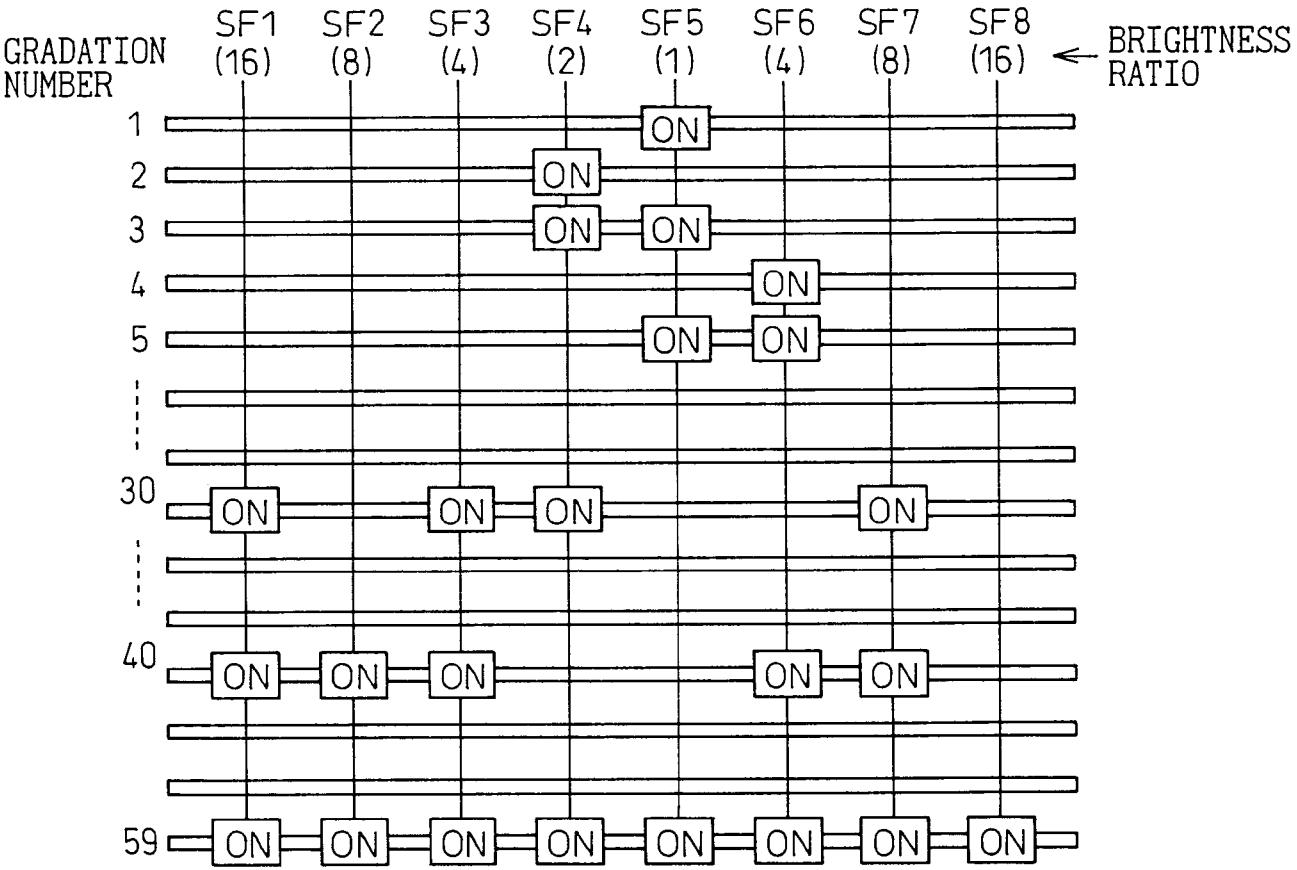
FIG. 10 is a diagram showing a relationship between the gradation of second group cells and a lighting sub-field.

FIG. 9 is a diagram showing a relationship between the gradation of first group cells and a lighting sub-field, and FIG. 10 is a diagram showing a relationship between the gradation of second group cells and a lighting sub-field. FIG. 9 and FIG. 10 are examples of a case of showing sixty gradations. Reference symbols SF1 to SF8 denote sub-fields. Sub-fields SF1 and SF8 have a brightness weight of 16 respectively. Sub-fields SF2 and SF7 have a brightness weight of 8 respectively, and sub-fields SF3 and SF6 have a brightness weight of 4 respectively.

It is generally true that a PDP has a plurality of sub-fields (SF1 to SF8) with different brightness weights for carrying out a gradation display. In this case, depending on a state of a sub-field to be lighted, there arises a problem of a pseud outline in a dynamic image. This is a unique phenomenon of a PDP that does not occur in a picture tube. How to solve this phenomenon has been an important theme from the viewpoint of improving the picture quality of the PDP. In order to solve this problem of a pseud outline in the dynamic image, there has been known a method of dispersing a lighting field, and making a predetermined gradation display in first group cells and second group cells by using mutually different lighting sub-fields, as shown in FIG. 9 and FIG. 10.

Specifically, in the case of expressing 30 gradations, for example, the sub-fields SF2, SF4, SF6 and SF8 are lighted as shown in FIG. 9. The gradation of 30 can also be obtained when all the sub-fields from SF1 to SF4, for example, are lighted. However, when the lighted sub-fields are concentrated at one portion, a flickering and a pseud outline become conspicuous in the dynamic image, which lowers the picture quality. In order to prevent the occurrence of this phenomenon, the sub-fields SF2, SF4, SF6 and SF8 are lighted to express the gradation of 30. The weights of the brightness of these sub-fields SF2, SF4, SF6 and SF8 are 8, 2, 4 and 6 respectively, and they add up to 30 in total. By dispersing the lighted sub-fields in the order of time like this, the lighting cycle becomes short. As a result, flickering and a pseud outline in the dynamic images are not seen by an eye.

Further, the gradation of 30 can also be obtained when the sub-fields SF1, SF3, SF4 and SF7 are lighted as shown in FIG. 10. The weights of the brightness of these sub-fields SF1, SF3, SF4 and SF7 are 16, 4, 2 and 8 respectively, and they add up to 30 in total. There has also been a measure for improving the state of a pseud outline in the dynamic image by alternately using the lighting sub-fields (SF2, SF4, SF6 and SF8) shown in FIG. 9 and the lighting sub-fields (SF1, SF3, SF4 and SF7) shown in FIG. 10 for each pixel (for example, R. G and B cells form one pixel).

In other words, when certain pixels (first group cells) have a lighting pattern of the sub-fields shown in FIG. 9, for example, the pixels (second group cells) that are adjacent to these pixels at above, below, left and right positions have a lighting pattern of the sub-fields shown in FIG. 10. Therefore, in the case of displaying a gradation of 40, for example, the sub-fields SF2, SF3, SF6, SF7 and SF8 are lighted in the first group cells, and the sub-fields SF1, SF2, SF3, SF6 and SF7 are lighted in the second group cells. In other words, as the sub-field having the brightness weight 16, the sub-field SF8 is used in the first group cells and the sub-field SF1 is used in the second group cells.

Figure 11A:
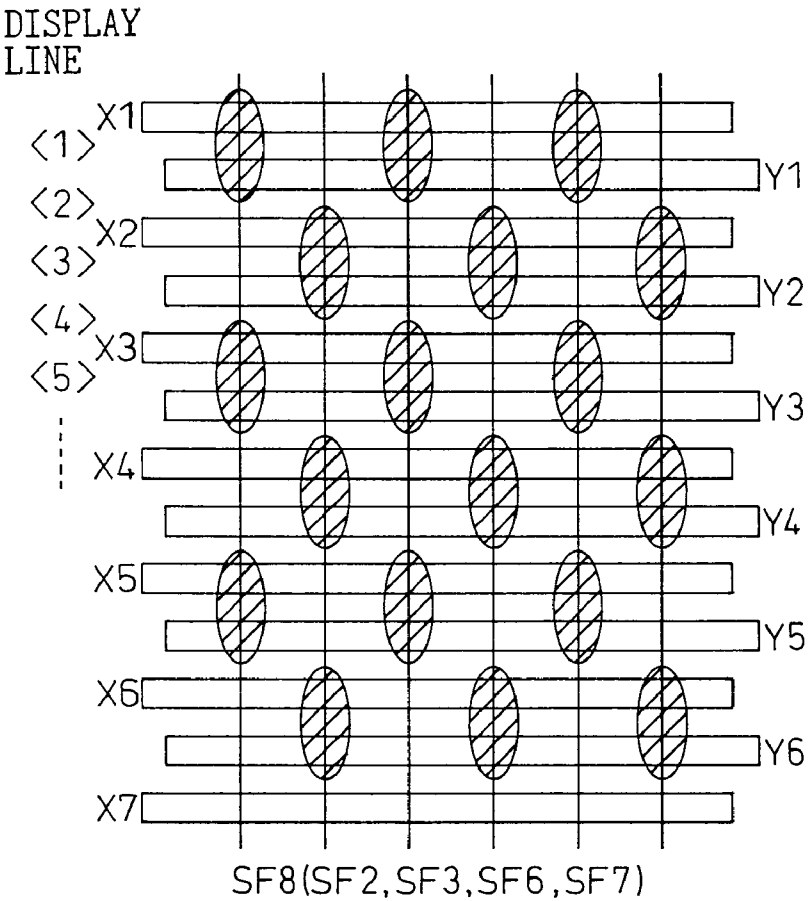
FIG. 11A and FIG. 11B are diagrams showing an example of a lighting pattern of two sub-fields.
Figure 11B:
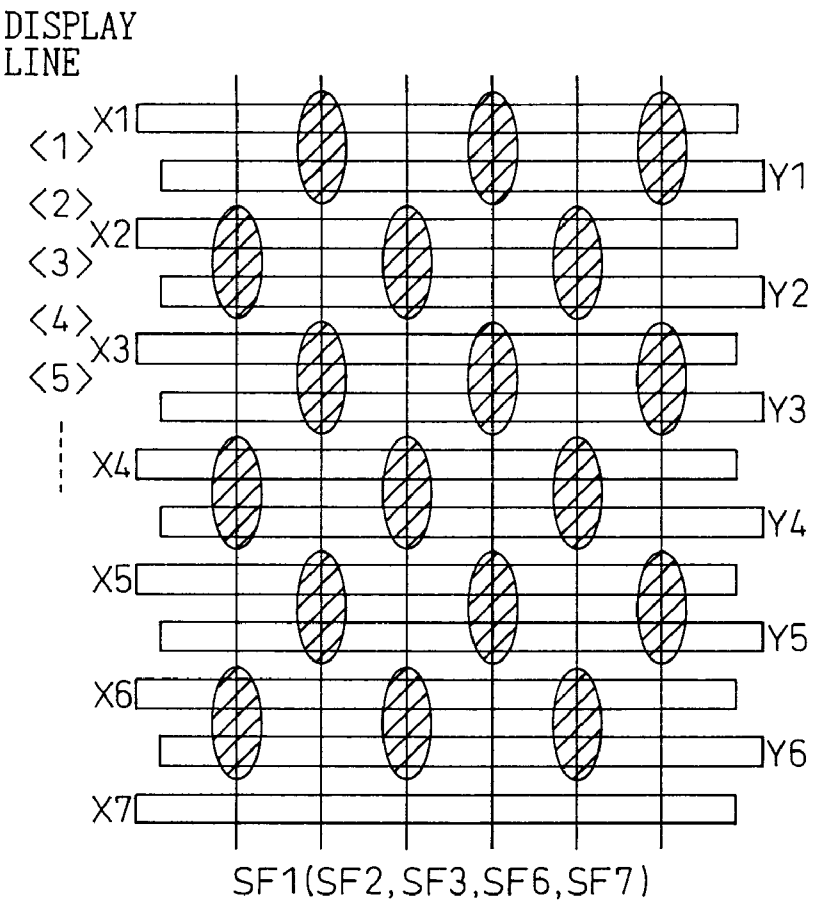

FIG. 11A and FIG. 11B are diagrams showing an example of a lighting pattern of two sub-fields. They show a state of displaying 40 gradations in all cells in the display of odd lines.

First, as is apparent from a comparison between FIG. 11A and FIG. 11B, in the display of the odd lines, the first group cells and the second group cells are positioned alternately in up and down directions and in left and right directions. In the case of displaying 40 gradations, for example, the sub-field SF8 is used as the sub-field having the brightness weight 16 in the first group cells. The sub-field SF1 is used as the sub-field having the brightness weight of 16 in the second group cells. As explained above, when the lighting sub-fields are dispersed by changing them for each pixel even when the sub-fields have the same gradation weight, it is possible to mitigate the pseud outline in the dynamic image. This technique has been successfully applied to PDPS currently in practical use. As an example of literature relating to this technique, there is Japanese Patent Application Laid-open Publication No. Hei 7-271325.

Figure 12:
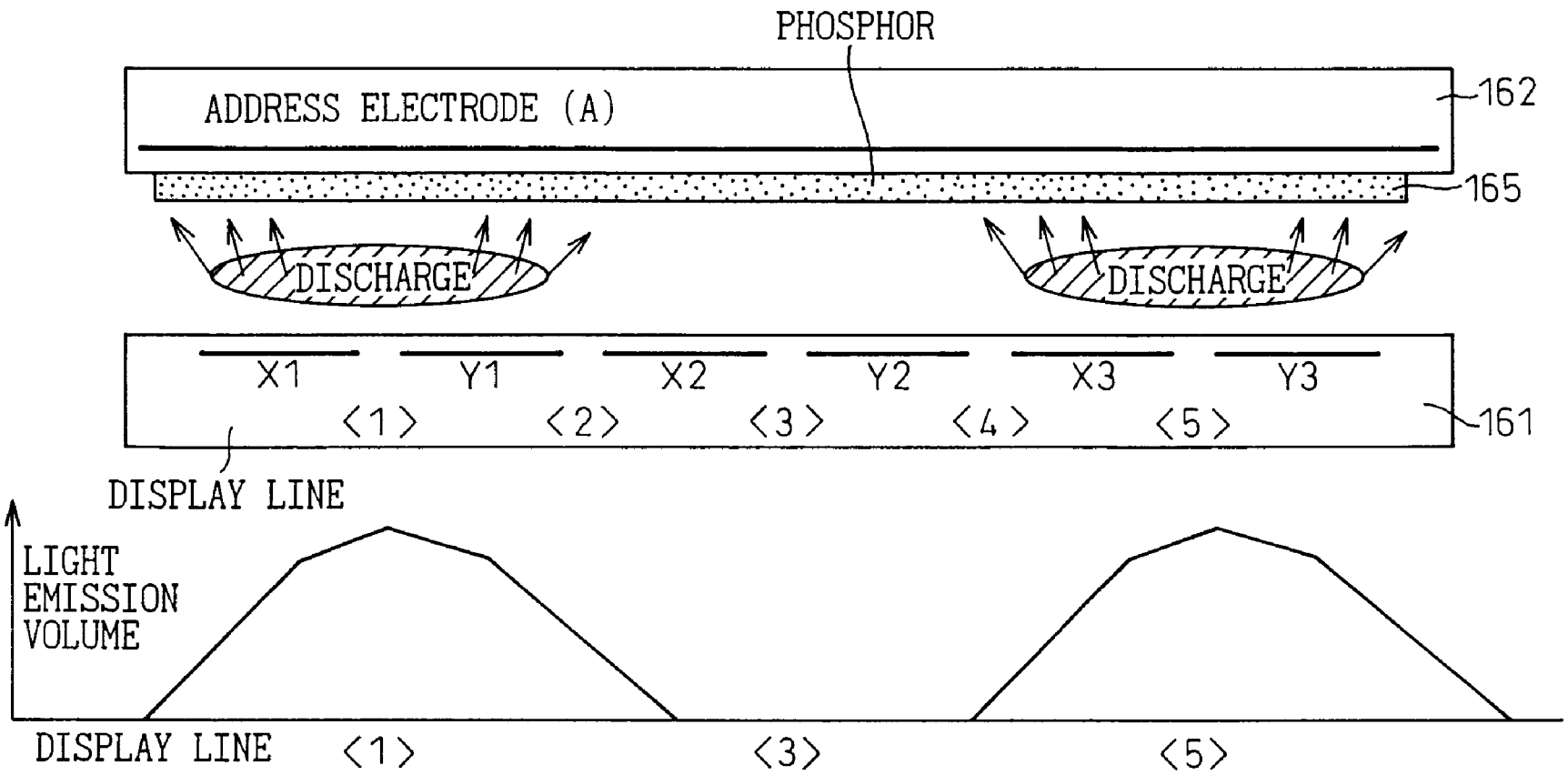
FIG. 12 is a diagram showing one example of a lighting pattern in a PDP of the ALIS system.
Figure 13:
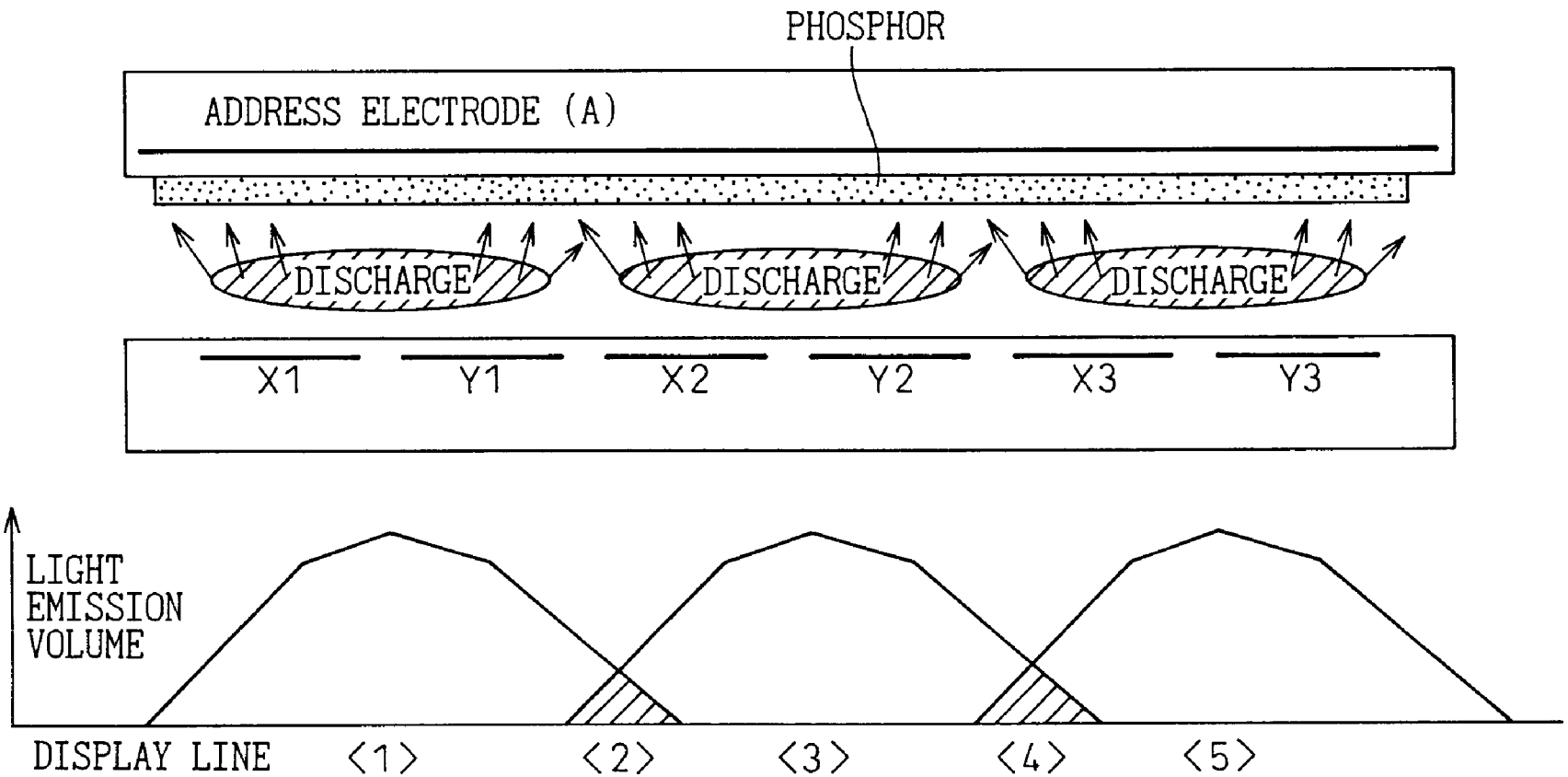
FIG. 13 is a diagram showing another example of a lighting pattern in a PDP of the ALIS system.

FIG. 12 is a diagram showing one example of a lighting pattern in a PDP of the ALIS system, and FIG. 13 is a diagram showing another example of a lighting pattern in a PDP of the ALIS system. FIG. 12 shows portions of lighting each one line in the display of odd lines in a PDP of the ALIS system, and FIG. 13 shows portions of lighting in continuous odd lines in the display of odd lines. In FIG. 12 and FIG. 13, a reference symbol 161 denotes a front glass substrate, 162 denotes a rear glass substrate, and 165 denotes a phosphor (R: 1651, G: 1652, and B: 1653).

In the PDP of the ALIS system shown in FIG. 8, a light emitting area is relatively larger than the interval between the display lines. Therefore, a light emission range of the display line <1> formed by a pair of electrodes X1 and Y1 and a light emission range of the display line <5> formed by a pair of electrodes X3 and Y3 extend respectively to the area of the display line <3> formed by a pair of electrodes X2 and Y2.

Therefore, in the display of the odd lines, there arise the following cases. As shown in FIG. 12, the light emission range of the display line <1> and the light emission range of the display line <5> are not superimposed with each other at portions where the lighting is carried out for each line (the display lines <1>, <5>, <9>, - - - ) in one sub-field. However, as shown in FIG. 13, the light emission range of the display line <1> and the light emission range of the display line <5> are superimposed with a part of the light emission range of the display line <3> at portions where the lighting is carried out in continuous odd lines (the display lines <1>, <3>, <5>, - - - ). In other words, as shown in FIG. 13, when the display lines <1>, <3> and <5> are lighted continuously in a certain sub-field, the light emission areas of the adjacent cells are partially superimposed on each other. It is needless to mention that this problem is not limited to the display of odd lines, but this occurs similarly in the display of even lines.

Assume that the brightness of the lighting pattern for each pixel as shown in FIG. 12 is 50. This brightness is not the brightness of only the light-emitting pixels but is an average brightness of a plane constant area including both light ON and OFF cells. This is an average value of the brightness of the ON cells embedded in the OFF cells.

Under this condition, when all the cells (the continuous cells of the odd lines <1>, <3>, <5>, - - - ) as shown in FIG. 13 are lighted, for example, the cells of two times the number of cells of the light emitting pattern of FIG. 12 are lighted. Therefore, in principle, the brightness of 100, which is two times the brightness of 50, can be obtained. However, in actual practice, the brightness of only about 90 is obtained due to the superimposition of the light emission areas. The PDP has such a characteristic that ultraviolet rays generated by a discharge excite the phosphors to generate a visible light, but there is a limit to a generation amount of the visible light. Thus, it is not possible to obtain visible light in excess of a constant level even if ultraviolet rays of more than a certain level are applied. In other words, there is a phenomenon that the output of a visible light is saturated for the input of ultraviolet rays of the phosphors. Therefore, depending on a display picture, it is not possible to obtain the brightness according to the number of sustain pulses determined by a specified gradation.

Viewed another way, in a case where all cells of a specific area are lighted in the lighting sub-fields shown in FIG. 9 and FIG. 10, for example, to display 59 gradations when all the sub-fields SF1 to SF8 are lighted, the brightness becomes 59. In the display of 40 gradations, the scheduled brightness is 40. However, the sub-fields SF1 and SF8 take the display pattern (there is no superimposition of light emission areas) as shown in FIG. 11A and FIG. 11B. Therefore, the brightness of these sub-fields becomes approximately 1.1 times. In other words, the sub-fields SF1 and SF8 that have the brightness of 16 in principle have the brightness of about 18. As a result, the actual brightness becomes 42 despite the intended brightness of 40.

As explained above, the conventional PDP of the ALIS system has a problem in that the linearity of the gradation fails depending on the display pattern. This problem is not limited to the PDP of the ALIS system. A similar problem also exists in a PDP in which there is a short interval between the discharged display lines, and the pitches of the cells are short so that the discharge in the adjacent cells is partially superimposed.

The principle of a method of driving a plasma display panel (PDP) relating to the present invention will be explained next.

Figure 14B:
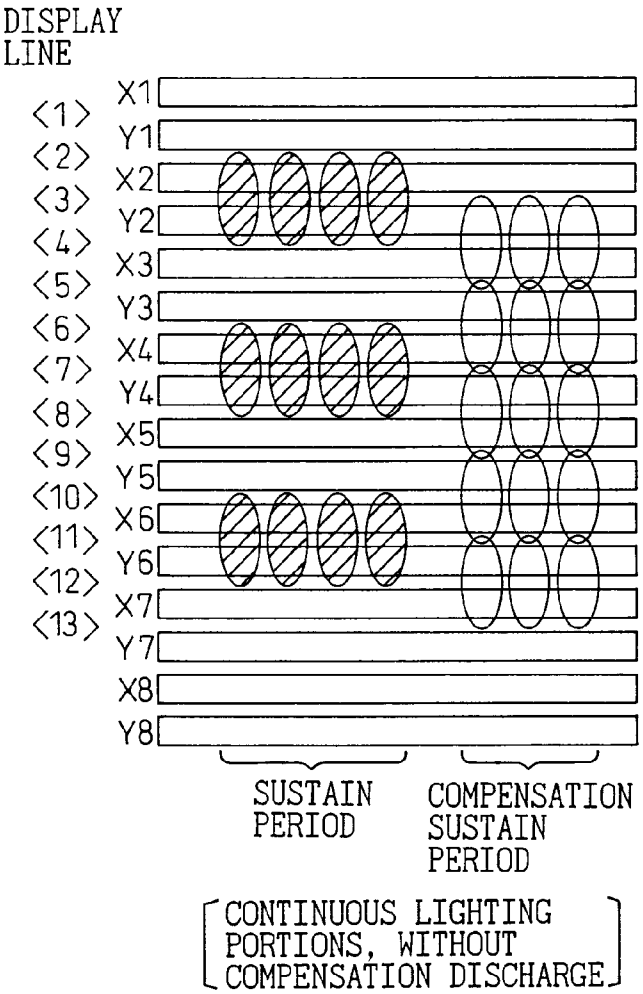
FIG. 14A and FIG. 14B are diagrams for explaining the principle of a method of driving a plasma display panel (PDP) relating to the present invention.
Figure 14A:
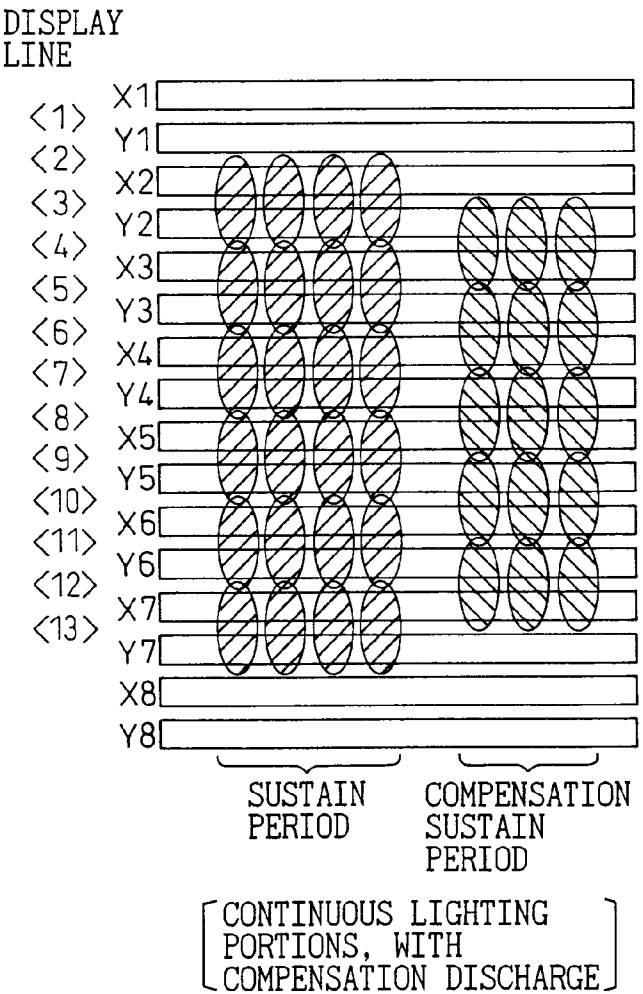

FIG. 14A and FIG. 14B are diagrams for explaining the principle of a method of driving a plasma display panel (PDP) relating to the present invention. FIG. 14A shows portions of a continuous lighting, and FIG. 14B shows portions of lighting in selected lines.

Looking at FIG. 13 again, when continuous lighting is carried out in the display of the odd lines (in a certain sub-field SFn), the brightness is low at portions between the adjacent cells that are in the lighted state (the cells of the odd display lines <1>, <3> and <5>). In other words, the brightness is low near the even display lines <2> and <4> (that is, the gap between the electrodes Y1 and X2, and the gap between the electrodes Y2 and X3).

According to the present invention, as shown in FIG. 14A, in the display of the odd lines, a sustain discharge that has not conventionally been carried out in the display of the odd lines is carried out on the even lines at the continuous lighting portions where the light emission areas of the adjacent cells are partially superimposed. With this arrangement, brightness compensation is carried out in the areas where the brightness is low due to the superimposition of the light emission areas. In other words, according to the present invention, a compensation sustain period is provided after the sustain period, as shown in FIG. 14A. During this compensation sustain period, a sustain discharge (a compensation sustain discharge) is additionally carried out for compensating for the brightness in the gaps (even lines) between the adjacent display lines (odd lines) above and below those that are emitting light. When the lighting cells are not adjacent above and below as shown in FIG. 14B, the compensation sustain discharge is not carried out during the compensation sustain period.

As explained above, according to the present invention, it is possible to increase the gradation display performance by avoiding the distortion in the brightness that is generated depending on the lighting pattern. Further, according to the present invention, it is also possible to prevent an occurrence of an abnormal discharge in the PDP as described later.

Embodiments of a plasma display panel (PDP) and a method of displaying the plasma display panel according to the present invention will be explained in detail with reference to the drawings.

Figure 15:
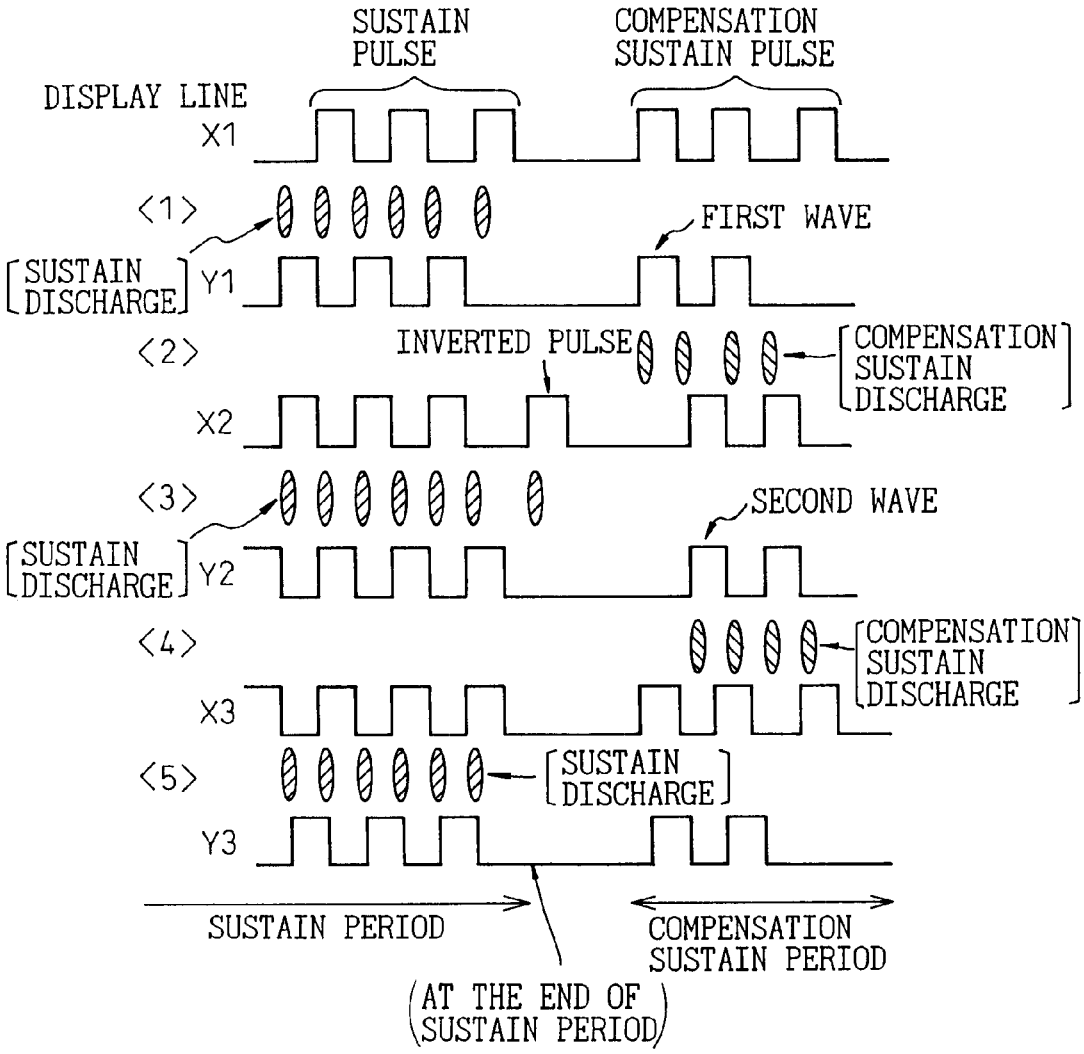
FIG. 15 is a diagram showing a driving waveform according to a first embodiment of a method of driving a PDP relating to the present invention.
Figure 16:
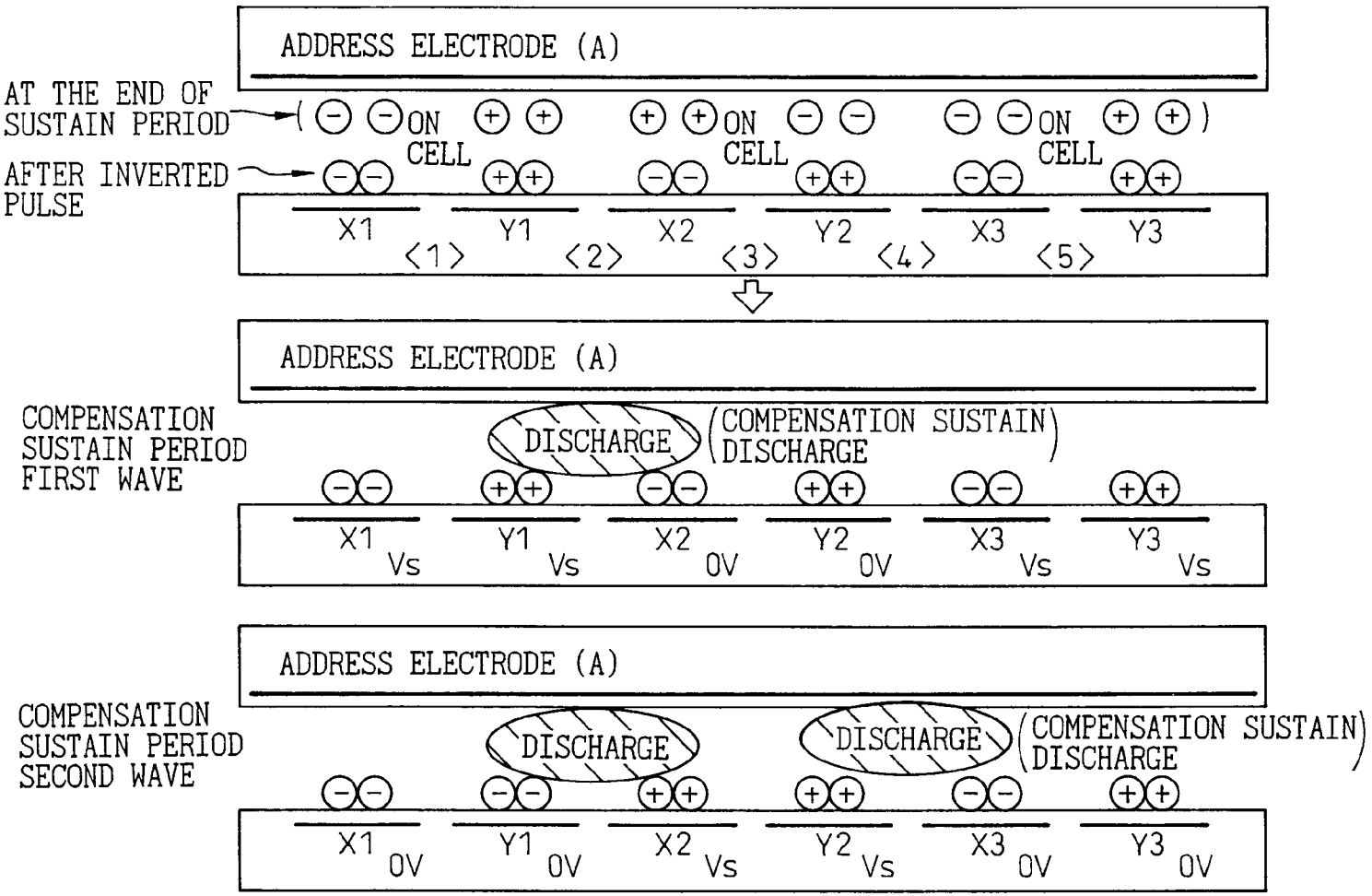
FIG. 16 is a diagram (part 1) for explaining the operation of the method of driving a PDP relating to the present invention shown in FIG. 15.
Figure 17:
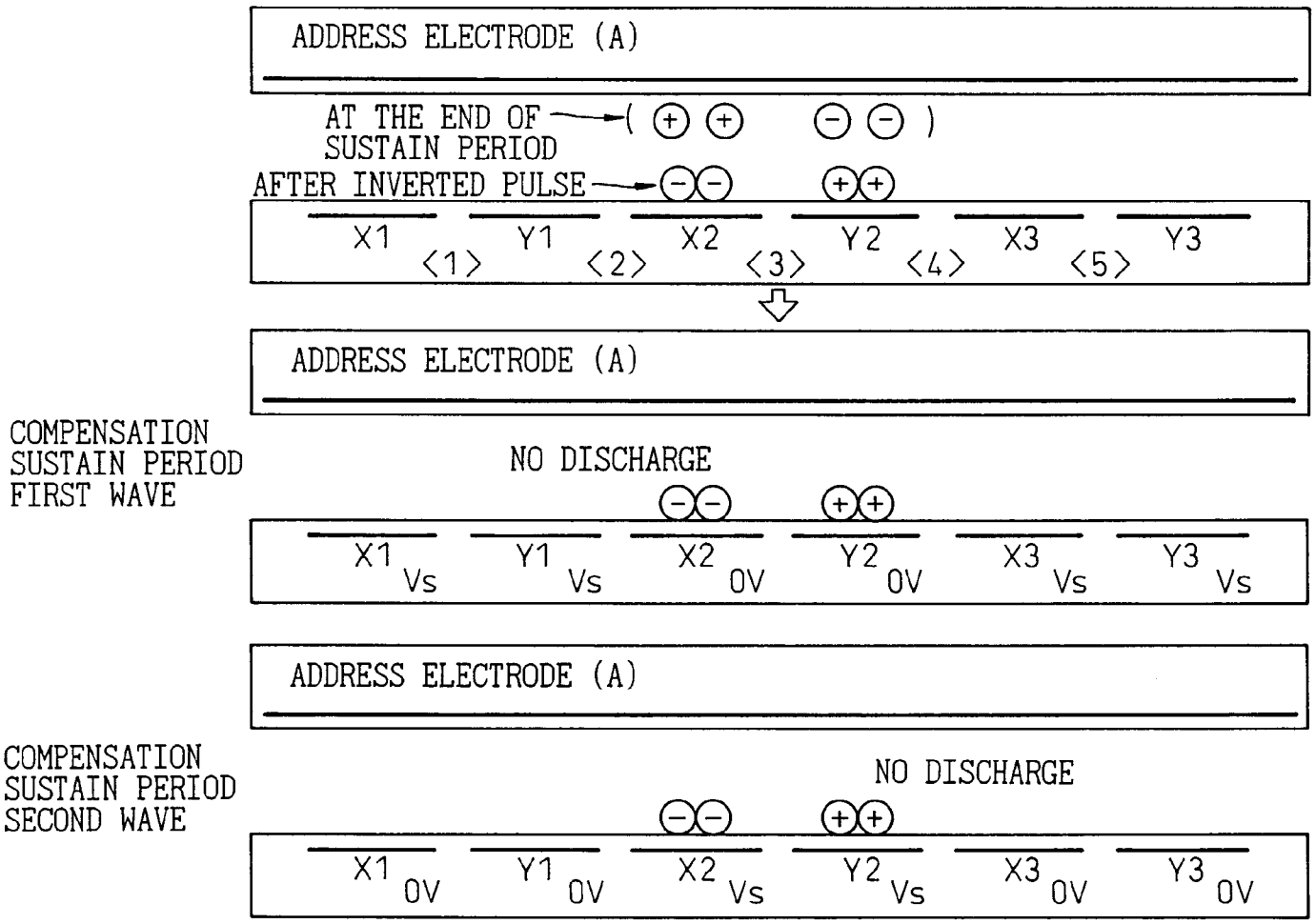
FIG. 17 is a diagram (part 2) for explaining the operation of the method of driving a PDP relating to the present invention shown in FIG. 15.

FIG. 15 is a diagram showing a driving waveform according to a first embodiment of a method of driving a PDP relating to the present invention, and FIG. 16 and FIG. 17 are diagrams for explaining the operation of the method of driving a PDP shown in FIG. 15. FIG. 15 to FIG. 17 show examples of a driving waveform in the display of the odd lines.

As shown in FIG. 15, during the sustain period, the timing of applying the sustain pulse (for example, a pulse of 2 to 5 μs at 150 to 180 V) is controlled to generate a sustain discharge on the odd display lines <1>, <3>, <5>, - - - , as explained with reference to FIG. 3B and FIG. 5. In other words, a sustain discharge is generated on the odd display lines (for example, the display line <1>), by applying a high voltage between the electrode X1 and the electrode Y1 based on an application of an opposite-phase sustain pulse to these electrodes, and by superimposing this high voltage on the wall charge. On the other hand, a sustain discharge is not generated on the even display lines (for example, the display line <2>), by suppressing a potential difference between the electrode Y1 and the electrode X1 based on an application of an in-phase sustain pulse to these electrodes. Based on this arrangement, the odd lines are displayed in the PDP of the ALIS system.

As shown in FIG. 15 and FIG. 16, a potential difference (wall voltage) is generated between the electrode X1 and the electrode Y1 corresponding to the odd display line <1>, between the electrode X2 and the electrode Y2 corresponding to the odd display line <3>, and between the electrode X3 and the electrode Y3 corresponding to the odd display line <5>, at the end of the sustain period. As a result, a potential difference is not generated between the electrode Y1 and the electrode X2 corresponding to the even display line <2>, and between the electrode Y2 and the electrode X3 corresponding to the even display line <4>.

According to the present embodiment, an inverted pulse (for example, a pulse of 5 to 10 μs at 160 to 200 V) is applied to the electrode X2 after the end of the sustain period, thereby to invert the charges of the electrode X2 and the electrode Y2. Then, a voltage Vs is applied to the electrode Y1, and a zero voltage is applied to the electrode X2, at a first pulse during the compensation sustain period. The voltage of the wall charge is superimposed on this application voltage so that the application voltage becomes more than the discharge starting voltage. Then, a discharge (a compensation sustain discharge) starts on the even display line <2>. At this point of time, a voltage has already been applied to the even display line <4> between the electrode Y2 and the electrode X3. However, as the wall voltage is in the opposite polarity, a discharge is not generated to lower the effective voltage within the cell. At a second wave during the compensation sustain period, the wall voltage is superimposed at a point of time when the compensation pulse in the opposite polarity (the same as the sustain pulse: for example, 2 to 5 μs at 150 to 180 V) has been applied, and thus a discharge is started. Thereafter, the compensation sustain discharge of a predetermined number sufficient enough to compensate for the brightness is carried out repeatedly on the even display lines <2>, <4>, - - - . Then, the compensation sustain period finishes.

As explained above, according to the present embodiment, after the end of a sustain period similar to that of the conventional sustain period, an inverted pulse and a compensation sustain pulse are applied to a discharge gap (a slit: an even line in the case of a display of odd lines) in which a sustain discharge is not carried out so that a potential difference is generated in this gap. In this case, a compensation sustain pulse is applied to the slit side (an odd line) in which a discharge has been carried out during the intrinsic sustain period so as not to generate a potential difference or not to carry out a discharge even if a potential difference has been generated.

In this case, it is preferable that the compensation sustain discharge is carried out in at least the sub-fields (for example, the sub-fields SF1 and SF8 in FIG. 9, FIG. 11A and FIG. 11B) in which normal sustain discharge is carried out most. Further, the number of times of carrying out the compensation sustain discharge in each sub-field may be allocated in a ratio approximately proportional to the number of normal sustain discharge. It is preferable that the width of the inverted pulse is set larger than the width of the sustain discharge pulse to ensure the inversion of the charge.

Next, a description will be made of a case where each one line is lighted in the display of the odd lines as explained with reference to FIG. 12. FIG. 17 shows a case where a sustain discharge is not carried out on the odd lines <1>, <5>, - - - and a sustain discharge is carried out on the odd lines <3>, <7>, As shown in FIG. 17, in the display of the odd lines, an inverted pulse and a compensation sustain pulse are also applied for lighting each line, as explained with reference to FIG. 15 and FIG. 16. However, in the case of lighting each line, when a compensation sustain pulse similar to that as shown in FIG. 15 has been applied after inverting the charges of the electrode X2 and the electrode Y2 based on the application of the inverted pulse, a discharge (a compensation sustain discharge) is not generated on the even display lines <2>, <4>, - - - . Thus, the operation becomes similar to that when an inverted pulse and a compensation sustain pulse are not applied based on the provision of the compensation sustain period. In the case of the slit (an even display line) in which the compensation sustain discharge is carried out, the wall charge exists at only one side. Therefore, the voltage in this slit does not exceed the discharge starting voltage even when the compensation sustain voltage has been applied to this slit. As a result, no compensation sustain discharge is generated in this slit.

Therefore, by carrying out a compensation sustain discharge, it is possible to compensate for low brightness only when the brightness is lowered due to a partial superimposition of the light emission areas of the adjacent cells.

A PDP to which the present invention can be applied has a structure as shown in FIG. 7, for example, with an additional provision of a memory 110 in the control circuit 101. This memory 110 stores a number of sustain discharge carried out in the case of a superimposition of the light emission areas of the adjacent cells in each sub-frame SF. The control circuit 101 reads this number of the sustain discharge stored in this memory 110, and calculates a number of compensation sustain discharge corresponding to the sustain discharge. Based on a result of this calculation, the control circuit 101 makes compensation sustain discharge executed by the calculated number on the display lines corresponding to the slits in which the light emission areas are superimposed.

Figure 18:
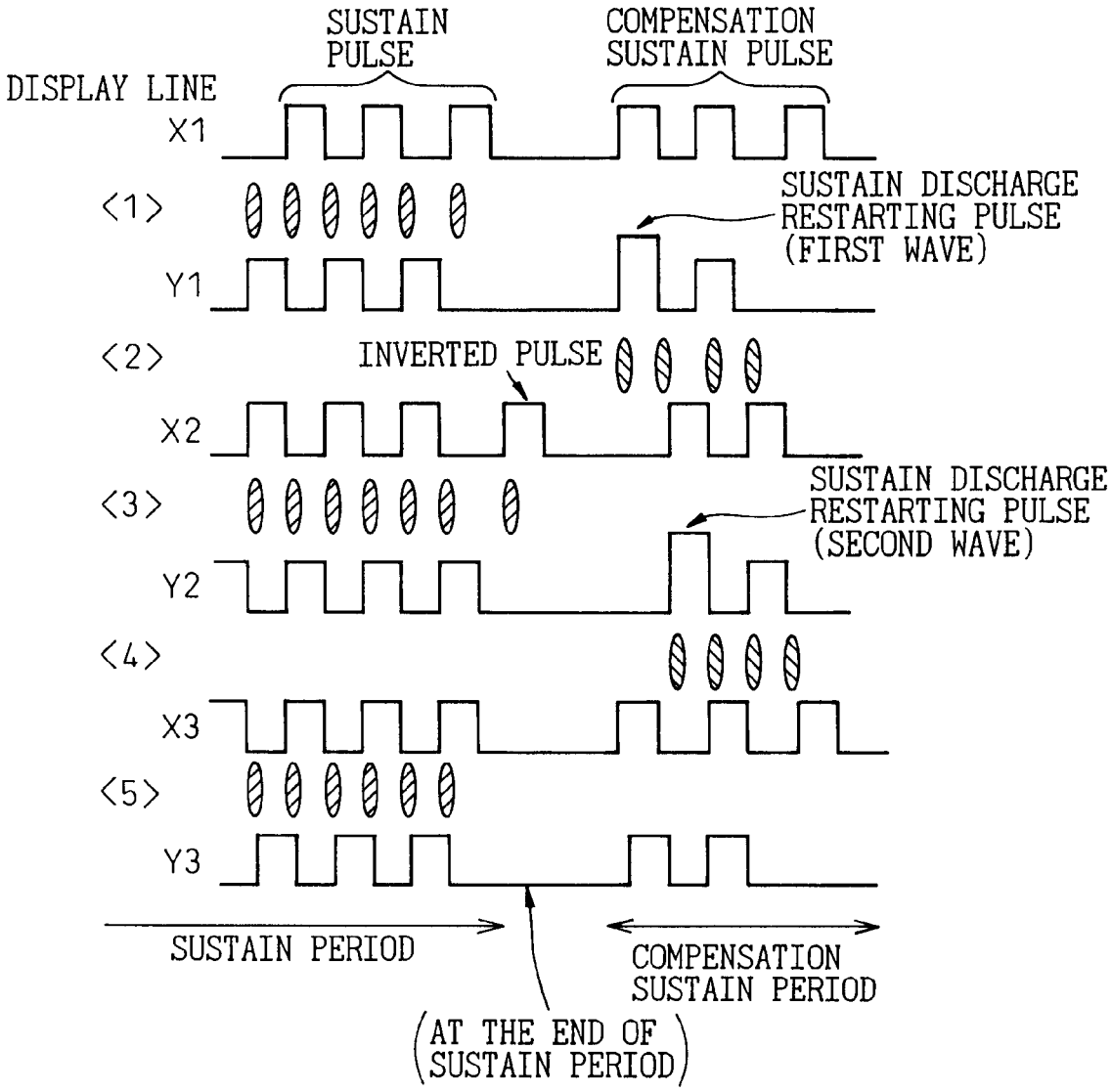
FIG. 18 is a diagram showing a driving waveform according to another embodiment of a method of driving a PDP relating to the present invention.

FIG. 18 is a diagram showing a driving waveform according to another embodiment of a method of driving a PDP relating to the present invention.

As shown in FIG. 18, according to the present embodiment, a slightly high voltage (for example, 160 to 200 V) is set as the voltage of a sustain discharge restarting pulse that is applied for starting a compensation sustain discharge (for restarting a sustain discharge). With this arrangement, the compensation sustain discharge is securely implemented.

Figure 19:
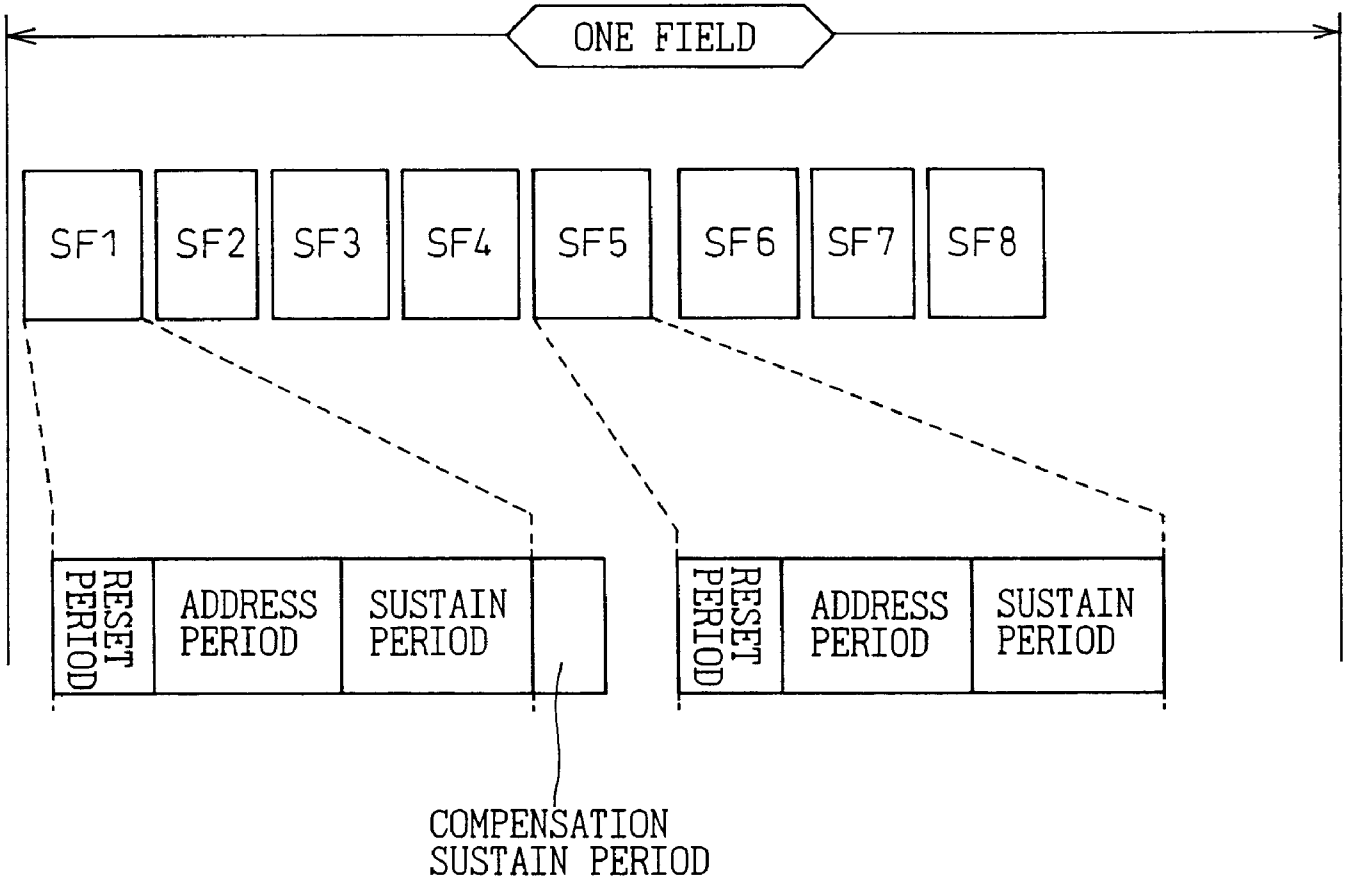
FIG. 19 is a diagram showing one example of a lighting sequence according to a method of driving a PDP relating to the present invention.

FIG. 19 is a diagram showing one example of a lighting sequence according to a method of driving a PDP relating to the present invention. FIG. 19 shows a lighting sequence of one field (an odd field or an even field) in a method of driving a PDP. One field consists of eight sub-fields SF1 to SF8.

In the example shown in FIG. 19, a compensation sustain discharge is carried out by providing a compensation sustain period in only sub-field that have a large brightness weight.

In FIG. 19, sub-fields SF1 and SF8 both with a large brightness weight have a sustain cycle number 192 and have a compensation sustain cycle number 19. Sub-fields SF2 and SF7 have a sustain cycle number 96 and have a compensation sustain cycle number 9. Sub-fields SF3 and SF6 have a sustain cycle number 48 and have a compensation sustain cycle number 5.

On the other hand, a sub-field SF4 has a sustain cycle number 24, and a sub-field SF5 has a sustain cycle number 12. However, these sub-fields have a small brightness weight, that is, a small sustain number. Therefore, a compensation sustain period is not provided in these sub-fields.

Numbers of compensation sustain cycles are different depending on discharge characteristics of panels and saturation characteristics of phosphors. Therefore, an optimum value that is suitable for each PDP is set as a compensation sustain cycle number at the time of designing the PDP. For example, the number of compensation sustain cycles in each sub-field SF can be set as about ten percent of the number of sustain cycles. However, when the superimposed portion of the light emission areas of the adjacent cells becomes large, the ratio of the compensation sustain cycle number to the sustain cycle number is set large.

Figure 20:
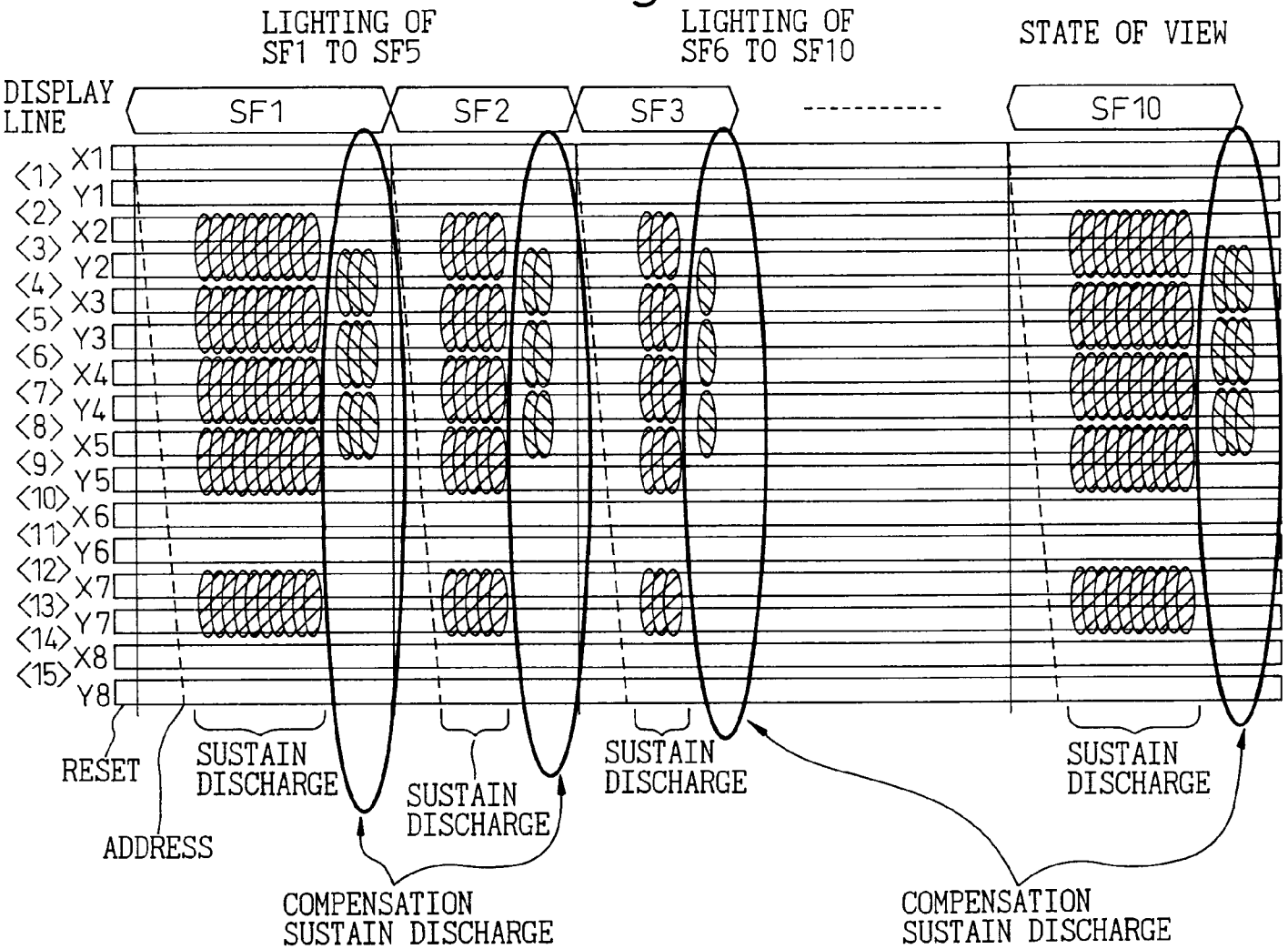
FIG. 20 is a diagram showing one example of a lighting state according to a method of driving a PDP relating to the present invention.

FIG. 20 is a diagram showing one example of a lighting state according to a method of driving a PDP relating to the present invention.

In FIG. 20, one field consists of ten sub-fields from SF1 to SF10.

The example of FIG. 20 can be realized based on a combination of the display panel shown in FIG. 8 and the driving circuit shown in FIG. 7, using the driving waveforms shown in FIG. 5 and FIG. 6 (however, one field consists of the sub-fields SF1 to SF10), with an addition of the compensation sustain period shown in FIG. 15 or FIG. 18 to the driving waveform.

According to the present invention, it is also possible prevent an occurrence of an abnormal discharge due to the accumulation of distorted charges, in addition to the achievement of the above-described compensation for the brightness. This will be explained below.

Figure 21:
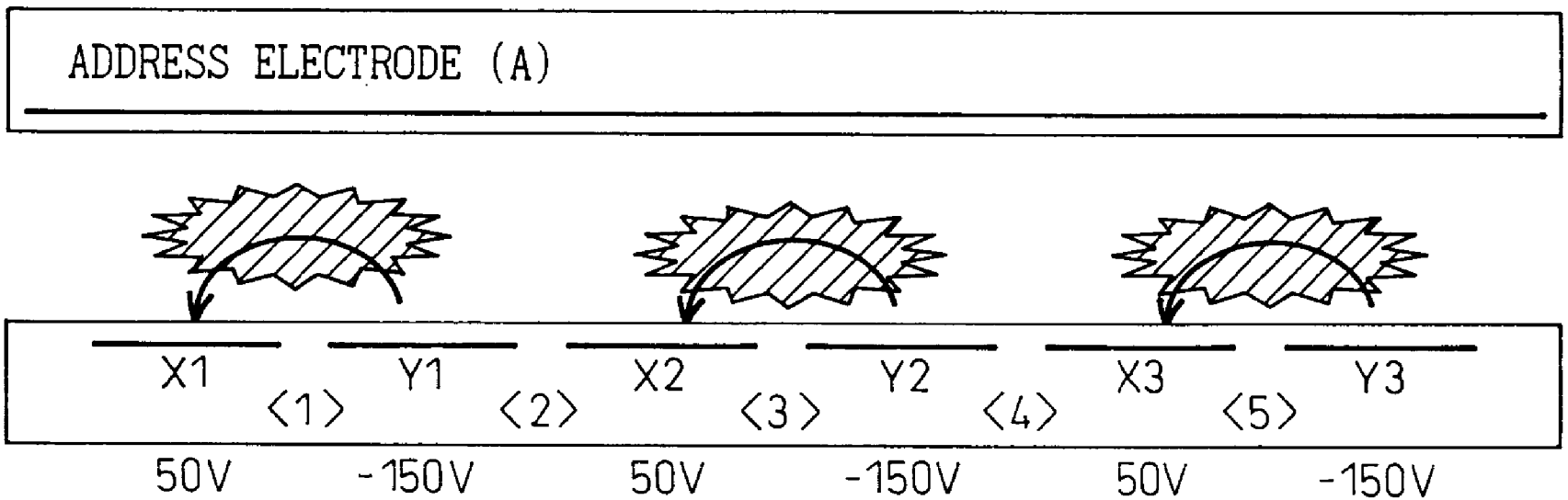
FIG. 21 is a diagram (part 1) for explaining a problem of a fixed display in a PDP of the ALIS system.
Figure 22A:
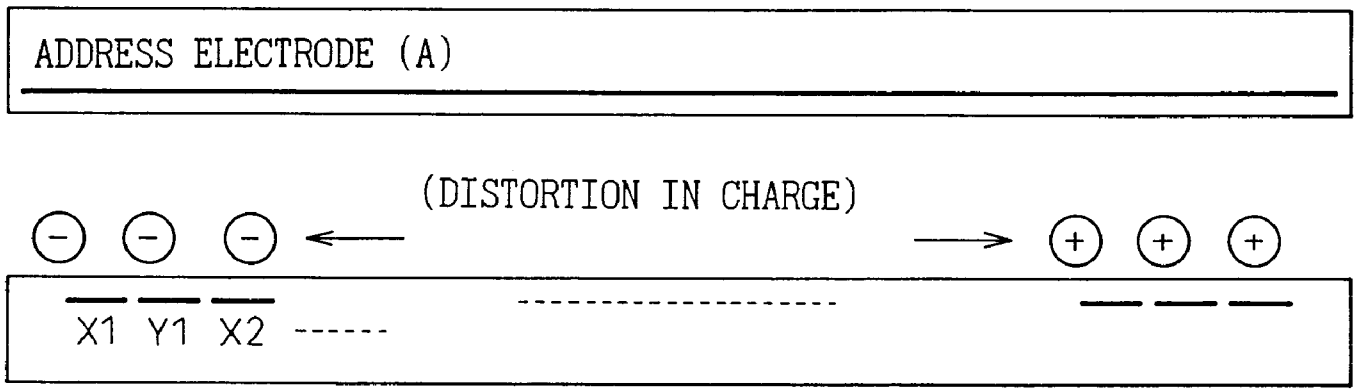
FIG. 22A and FIG. 22B are diagrams (part 2) for explaining a problem of a fixed display in a PDP of the ALIS system.
Figure 22B:
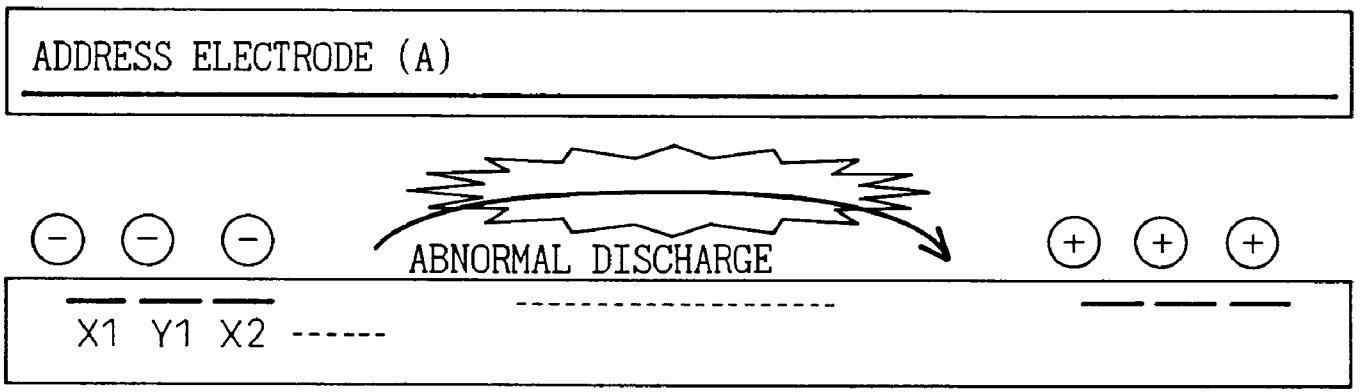

FIG. 21, FIG. 22A and FIG. 22B are diagrams for explaining a problem of a fixed display in a PDP of the ALIS system.

As explained above, according to the PDP of the ALIS system, the odd lines and the even lines are lighted by separate fields, as shown in FIG. 4. Therefore, as the display can be carried out using all slits (between the X-electrodes and the Y-electrodes), it is possible to obtain a high resolution of two times that obtained conventionally.

However, when a fine horizontal line is displayed, a flickering of a 30 Hz period, for example, may be sensed similar to the one sensed in the interlace display of a picture tube. Therefore, there has been a request for avoiding a flickering at the cost of a reduction in the resolution to a half in the display of information like characters. In the case of a display of information like characters, the display is carried out by always using, for example, only the odd lines, as shown in FIG. 21. When only the odd lines, for example, are used for the display, the address discharge becomes always in the same direction as shown in FIG. 21. When this driving (display) is repeated, a distortion in the electric charge occurs on the display panel as shown in FIG. 22A.

When the distorted accumulation of charges as shown in FIG. 22A progresses, a large-scale abnormal discharge may occur over a substantially long distance exceeding the pairs of the X-electrodes and the Y-electrodes as shown in FIG. 22B. This abnormal discharge can damage a normal operation thereafter, and can damage the circuit by breaking an insulation film with a large current.

According to the present invention, the discharge is carried out in the slits in which the discharge has not been conventionally carried out based on the prior-art technique. Therefore, there is an effect that it is possible to prevent an abnormal discharge in the display panel by avoiding the distortion of charges.

Figure 23:
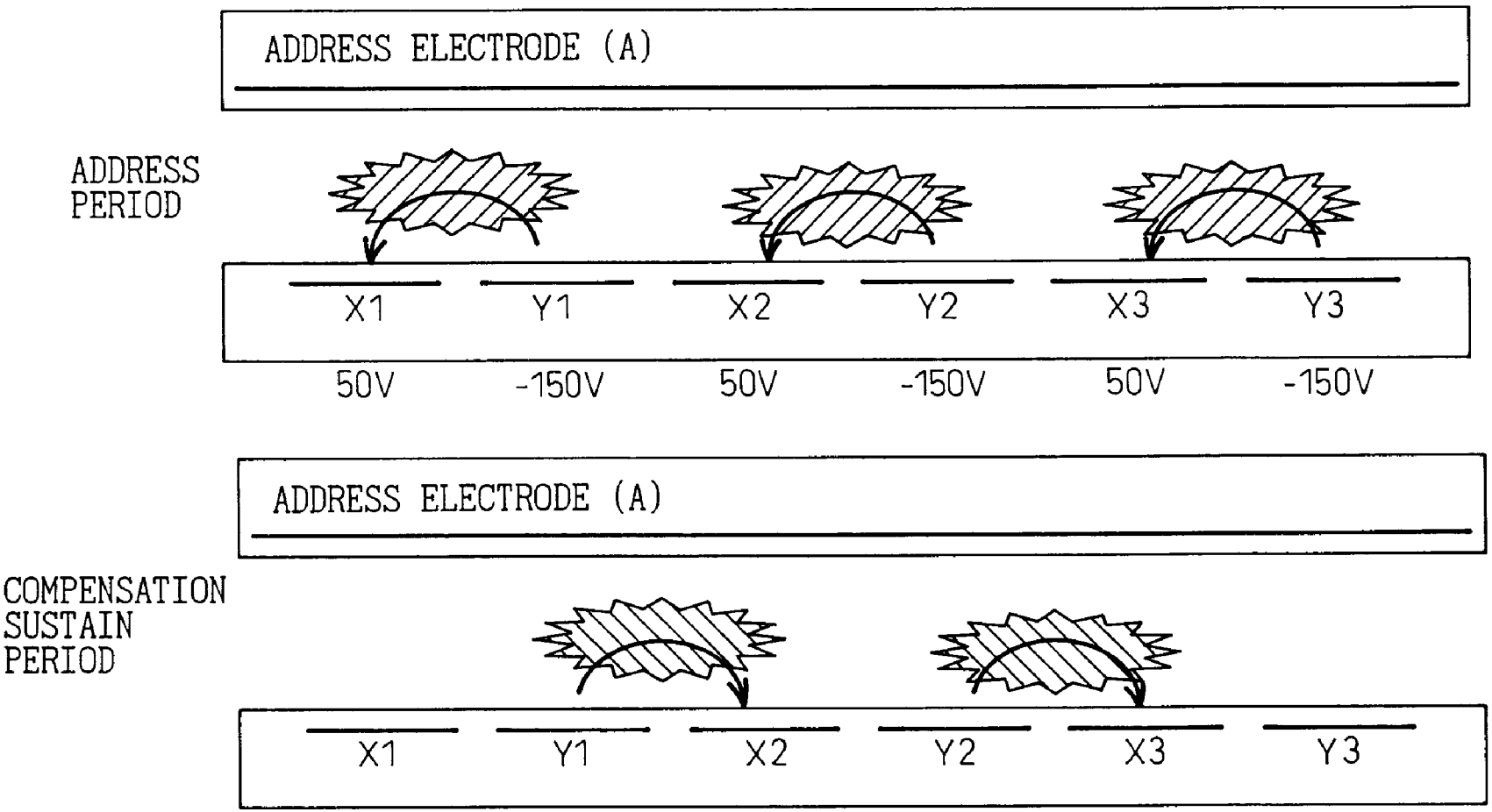
FIG. 23 is a diagram for explaining a work effect of a method of driving a PDP relating to the present invention.

FIG. 23 is a diagram for explaining a work effect of a method of driving a PDP relating to the present invention. As is apparent from FIG. 23, when the present invention is applied, the discharge during the address period (the address discharge) and the discharge during the compensation sustain period (the compensation sustain discharge) face in the opposite directions on the display panel. Therefore, it is possible to avoid the accumulation of distorted charges on the display panel, and thus it becomes possible to prevent an abnormal discharge.

While a description has been made of a case where the present invention is applied to mainly a PDP of the ALIS system (particularly the display of the odd lines), the application of the present invention is not limited to the PDP of the ALIS system. It is also possible to widely apply the present invention to a PDP in which charges are superimposed in adjacent cells, with short pitches of the cells in which a discharge is carried out.

As explained above in detail, according to the present invention, it is possible to increase the gradation display performance by avoiding a distortion in the brightness that is generated depending on the lighting pattern. Further, according to the present invention, it is also possible to prevent an occurrence of an abnormal discharge in the PDP.

Many different embodiments of the present invention may be constructed without departing from the spirit and scope of the present invention, and it should be understood that the present invention is not limited to the specific embodiments described in this specification, except as defined in the appended claims.

What is claimed is:

1. A method of driving a plasma display panel having a plurality of first electrodes and a plurality of second electrodes adjacently disposed alternately, first display lines being formed between said first electrodes and said second electrodes adjacent to a first side of said first electrodes, second display lines being formed between said first electrodes and said second electrodes adjacent to a second side of said first electrodes, said first and second display lines alternately lighting or only one of said first and second display lines lighting, and an image being displayed on said plasma display panel by dividing a frame or a field into a plurality of sub-fields for a gradation display, comprising:

carrying out normal sustain discharges in a sustain discharge; and after the sustain discharge period, carrying out compensation sustain discharges on said second display lines or on said first display lines, positioned between the adjacent first display lines or between the adjacent second display lines, when cells are lighted on the adjacent first display lines or on the adjacent second display lines, respectively, in a direction crossing said first and second electrodes.

2. The method of driving the plasma display panel as claimed in claim 1, wherein said first electrodes and said second electrodes are disposed alternately in parallel with each other, and cells that are lighted on the adjacent first display lines or on the adjacent second display lines are cells on said first display lines or said second display lines that are adjacent to each other in a direction orthogonal with said first and second electrodes.

3. The method of driving the plasma display panel as claimed in claim 1, wherein the compensation sustain discharges are carried out in at least sub-fields in which the normal sustain discharges are carried out more than a predetermined number of times.

4. The method of driving the plasma display panel as claimed in claim 1, wherein a number times of carrying out the compensation sustain discharges in each sub-field is allocated in a ratio approximately proportional to a number of normal sustain discharges.

5. The method of driving the plasma display panel as claimed in claim 1, wherein a width of a pulse discharged at a beginning of the compensation sustain discharges is set larger than among widths of compensation sustain discharge pulses.

6. The method of driving the plasma display panel as claimed in claim 1, wherein the method comprises:

applying a sustain discharge pulse to cancel a voltage of said second display lines when the normal sustain discharges are carried out on said first display lines, or applying a sustain discharge pulse to cancel a voltage of said first display lines when the normal sustain discharges are carried out on said second display lines;

inverting wall charges of cells where the normal sustain discharges are carried out by applying an inverted pulse necessary for a discharge only between pairs of electrodes of either odd display lines or even display lines among said first display lines; and carrying out compensation sustain discharges by applying compensation sustain discharge pulses such that a voltage is generated between electrodes that form display lines where the normal sustain discharges are not carried out during an immediately preceding sustain discharge period, and that a voltage is not generated between electrodes that form display lines where the normal sustain discharges are carried out during the immediately preceding sustain discharge period.

7. The method of driving the plasma display panel as claimed in claim 6, wherein a width of the inverted pulse is set larger than a width of the sustain discharge pulse.

8. The method of driving the plasma display panel as claimed in claim 6, wherein a voltage of the inverted pulse is set higher than a voltage of the sustain discharge pulse.

9. The method of driving the plasma display panel as claimed in claim 6, wherein a voltage of a pulse discharged at a beginning of the compensation sustain discharges is set higher than among voltages of the compensation sustain discharge pulses.

10. The method of driving the plasma display panel as claimed in claim 6, further comprising:

applying a voltage pulse necessary for a discharge to only pairs of electrodes of odd or even display lines among said first or second display lines where the compensation sustain discharges are carried out, whereby wall charges of cells where the compensation sustain discharges are carried out are inverted and polarities of wall charges formed on said first electrodes and on said second electrodes are matched on the respective electrodes.

11. A plasma display panel comprising:

a plurality of first electrodes;

a plurality of second electrodes adjacently disposed alternately with said first electrodes; first display lines formed between said first electrodes and said second electrodes adjacent to a first side of said first electrodes;

second display lines formed between said first electrodes and said second electrodes adjacent to a second side of said first electrodes; and a control circuit alternately lighting said first and second display lines or lighting only one of said first and second display lines, and displaying an image on said plasma display panel by dividing a frame or a field into a plurality of sub-fields for a gradation display, wherein:

when cells are lighted on the adjacent first display lines or on the adjacent second display lines in a direction crossing said first and second electrodes, compensation sustain discharges are carried out on said second display lines or on said first display lines, respectively, after a sustain discharge period on said first or second display lines is finished, said second display lines or said first display lines being positioned between the adjacent first display lines or positioned between the adjacent second display lines, respectively.

12. The plasma display panel as claimed in claim 11, further comprising:

a memory storing a number of times of carrying out normal sustain discharges on the cells that are lighted on the adjacent first display lines or on the adjacent second display lines, and controlling a number times of carrying out compensation sustain discharges on said second display lines positioned between the adjacent first display lines or on said first display lines positioned between the adjacent second display lines, according to the number of times of carrying out the normal sustain discharges stored in said memory.

13. The plasma display panel as claimed in claim 11, wherein said first electrodes and said second electrodes are disposed alternately in parallel with each other, and the cells that are lighted on the adjacent first display lines or on the adjacent second display lines are cells on said first display lines or said second display lines that are adjacent to each other in a direction orthogonal with said first and second electrodes.

14. The plasma display panel as claimed in claim 11, wherein the compensation sustain discharges are carried out in at least sub-fields in which normal sustain discharges are carried out more than a predetermined number of times.

15. The plasma display panel as claimed in claim 11, wherein a number of times of carrying out the compensation sustain discharges in each sub-field is allocated in a ratio approximately proportional to a number of normal sustain discharges.

16. The plasma display panel as claimed in claim 11, wherein a width of a pulse discharged at a beginning of the compensation sustain discharges is set larger than among widths of compensation sustain discharge pulses.

17. The plasma display panel as claimed in claim 11, wherein:

when normal sustain discharges are carried out on said first display lines, a sustain discharge pulse is applied to cancel a voltage of said second display lines, or when the normal sustain discharges are carried out on said second display lines, a sustain discharge pulse is applied to cancel a voltage of said first display lines, thereby finishing a sustain discharge period;

an inverted pulse necessary for a discharge is applied only between pairs of electrodes of either odd display lines or even display lines among said first display lines, thereby to invert wall charges of cells where the normal sustain discharges are carried out; and compensation sustain discharge pulses are applied such that a voltage is generated between electrodes that form display lines where the normal sustain discharges are not carried out during an immediately preceding sustain discharge period, and that a voltage is not generated between electrodes that form display lines where the normal sustain discharges are carried out during the immediately preceding sustain discharge period, thereby to carry out compensation sustain discharges a predetermined number of times.

18. The plasma display panel as claimed in claim 17, wherein a width of the inverted pulse is set larger than a with of the sustain discharge pulse.

19. The plasma display panel as claimed in claim 17, wherein a voltage of the inverted pulse is set higher than a voltage of the sustain discharge pulse.

20. The plasma display panel as claimed in claim 17, wherein a voltage of a pulse discharged at a beginning of the compensation sustain discharges is set higher than among voltages of the compensation sustain discharge pulses.

21. The plasma display panel as claimed in claim 17, wherein after carrying out the compensation sustain discharges, a voltage pulse necessary for a discharge is applied to only pairs of electrodes of odd or even display lines among said first or second display lines where the compensation sustain discharges are carried out, thereby to invert wall charges of cells where the compensation sustain discharges are carried out, and polarities of wall charges formed on said first electrodes and on said second electrodes are matched on the respective electrodes.

22. A method of driving a plasma display panel having a plurality of first electrodes and a plurality of second electrodes adjacently disposed alternately, first display lines being formed between said first electrodes and said second electrodes adjacent to a first side of said first electrodes, second display lines being formed between said first electrodes and said second electrodes adjacent to a second side of said first electrodes, said first and second display lines alternately lighting or only one of said first and second display lines lighting, and an image being displayed on said plasma display panel by dividing a frame or a field into a plurality of sub-fields for a gradation display, comprising:

carrying out normal sustain discharges in a normal sustain discharge period to alternately light said first and second display lines or to light only one of said first and second display lines; and after the normal sustain discharge period, carrying out compensation sustain discharges in a compensation sustain discharge period on said second display lines or on said first display lines when cells, in the normal sustain discharge period, are lighted on the adjacent first display lines or on the adjacent second display lines, respectively, in a direction crossing said first and second electrodes.

23. A plasma display panel comprising:

a plurality of first electrodes;

a plurality of second electrodes adjacently disposed alternately with said first electrodes; first display lines formed between said first electrodes and said second electrodes adjacent to a first side of said first electrodes;

second display lines formed between said first electrodes and said second electrodes adjacent to a second side of said first electrodes; and a control circuit in a normal sustain period alternately lighting said first and second display lines or lighting only one of said first and second display lines, and displaying an image on said plasma display panel by dividing a frame or a field into a plurality of sub-fields for a gradation display, and, in a compensation sustained discharge period after the normal sustain discharge period, compensation sustain discharges are carried out on said second display lines or on said first display lines when cells, in the normal sustain period, are lighted on the adjacent first display lines or on the adjacent second display lines, respectively, in a direction crossing said first and second electrodes.

* * * * *